US010648297B2

(12) United States Patent
DeLange et al.

(10) Patent No.: US 10,648,297 B2
(45) Date of Patent: May 12, 2020

(54) EXPANDABLE LINER

(71) Applicant: Weatherford/Lamb, Inc., Houston, TX (US)

(72) Inventors: Richard W. DeLange, Kingwood, TX (US); John Richard Setterberg, Jr., Huntsville, TX (US); Scott H. Osburn, Conroe, TX (US); Ghazi J. Hashem, Pasadena, TX (US); Gregory Guy Galloway, Conroe, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 574 days.

(21) Appl. No.: 13/954,594

(22) Filed: Jul. 30, 2013

(65) Prior Publication Data

US 2014/0027118 A1 Jan. 30, 2014

Related U.S. Application Data

(60) Provisional application No. 61/843,198, filed on Jul. 5, 2013, provisional application No. 61/798,095, filed on Mar. 15, 2013, provisional application No. 61/693,669, filed on Aug. 27, 2012, provisional application No. 61/677,383, filed on Jul. 30, 2012.

(51) Int. Cl.

| | |
|---|---|
| ***E21B 23/00*** | (2006.01) |
| ***E21B 43/10*** | (2006.01) |
| ***E21B 23/01*** | (2006.01) |
| ***E21B 29/10*** | (2006.01) |

(52) U.S. Cl.

CPC ..... *E21B 43/103* (2013.01); *E21B 23/00* (2013.01); *E21B 23/01* (2013.01); *E21B 29/10* (2013.01)

(58) Field of Classification Search

None

See application file for complete search history.

(56) References Cited

U.S. PATENT DOCUMENTS

| | | | | |
|---|---|---|---|---|
| 7,275,601 | B2 * | 10/2007 | Cook | E21B 43/10 166/207 |
| 8,162,067 | B2 | 4/2012 | Ring et al. | |
| 2003/0075333 | A1 * | 4/2003 | Vercaemer | E21B 43/103 166/308.1 |
| 2004/0069498 | A1 | 4/2004 | Simpson et al. | |
| 2004/0194966 | A1 | 10/2004 | Zimmerman | |
| 2004/0231860 | A1 | 11/2004 | Whanger et al. | |
| 2005/0045342 | A1 * | 3/2005 | Luke | E21B 29/10 166/384 |

(Continued)

OTHER PUBLICATIONS

PCT Search Report and Written Opinion for International Application No. PCT/US2013/052759 dated Nov. 11, 2014.

(Continued)

*Primary Examiner* — Caroline N Butcher

(74) *Attorney, Agent, or Firm* — Patterson + Sheridan, LLP

(57) ABSTRACT

An expandable liner is used to re-complete a wellbore for a re-fracturing operation. The expandable liner may be used to cover the old perforations and provide a larger bore after expansion. The larger bore allows the new completion perforations and fracturing operation to be more easily achieved. In one embodiment, the expandable liner may have a rib disposed around an outer diameter of the expandable tubular, wherein the rib is configured to form a seal with the outer tubular.

21 Claims, 30 Drawing Sheets

(56) References Cited

U.S. PATENT DOCUMENTS

| | | | | |
|---|---|---|---|---|
| 2005/0133225 | A1 | 6/2005 | Oosterling | |
| 2006/0162145 | A1 | 7/2006 | Verger et al. | |
| 2006/0162937 | A1 | 7/2006 | Costa et al. | |
| 2009/0166040 | A1* | 7/2009 | Cavender | E21B 43/103 166/281 |
| 2010/0270035 | A1* | 10/2010 | Ring | E21B 43/103 166/384 |
| 2012/0061097 | A1* | 3/2012 | O'Connor | E21B 43/105 166/381 |
| 2012/0126482 | A1* | 5/2012 | Hiorth | E21B 29/10 277/339 |

OTHER PUBLICATIONS

Canadian Office Action dated Jan. 22, 2016, for Canadian Patent Application No. 2,880,558.
Canadian Office Action dated Aug. 1, 2016, for Canadian Patent Application No. 2,880,558.
PCT International Preliminary Report on Patentability dated Feb. 12, 2015, for International Application No. PCT/US2013/052759.
Australian Examination Report dated Aug. 18, 2017, for Australian Patent Application No. 2013296654.
EPO Examination Report dated Nov. 28, 2017, for European Patent Application No. 13750193.8.
Australian Examination Report dated Dec. 6, 2017, for Australian Patent Application No. 2013296654.
EPO Office Action dated Jul. 10, 2018, for European Application No. 137501918.
Canadian Office Action dated May 14, 2019, for Canadian Patent Application No. 2,986,866.

* cited by examiner

EXPANDABLE LINER

CROSS-REFERENCE TO RELATED APPLICATIONS

This application claims benefit of U.S. Provisional Patent Application Ser. No. 61/843,198, filed Jul. 5, 2013; U.S. Provisional Patent Application Ser. No. 61/798,095, filed Mar. 15, 2013; U.S. Provisional Patent Application Ser. No. 61/693,669, filed Aug. 27, 2012; and Provisional Patent Application Ser. No. 61/677,383, filed Jul. 30, 2012, which applications are incorporated herein by reference in their entirety.

BACKGROUND OF THE INVENTION

Field of the Invention

Embodiments of the present invention generally relate to an expandable liner. In particular, embodiments of the present invention relate to an expandable liner for a fracturing operation and methods of installing the liner.

Description of the Related Art

Expandable tubular liners have been used in existing wellbores as a repair liner or in open hole as a drilling liner. These liners can be just a few joints of pipe or can be more than one hundred joints. These joints may be 30 to 40 feet in length and are connected using a threaded connection. In some instances, the connection is a flush pipe connection, which has a similar wall thickness to the pipe wall thickness. This type of connection will be much weaker in tension, compression, or bending than the pipe body. For example, these expandable threaded connections may have tension and compression strengths that are about 50% of the pipe body.

In most repair or open hole applications, the tension or compression loads applied to the unexpanded connections is equal to the buoyed weight of the liner, plus any bending that might be present. In the case of the liner being set at bottom of the well, the liner would experience a compression load due to its own weight. After expansion, the liner may be fixed against the outer or parent casing or open hole by the expanded external rubber seals. In this position, applied internal or external pressure may cause the liner to shrink. However, because the liner is fixed and cannot shrink, the liner and its connections will experience additional tension loads as a consequence of the applied pressure.

Changes in wellbore conditions may increase the tension load on the expandable tubular connection. In addition to the tension load generated during expansion, there are at least three other potential sources of tension load. The tension loads from these sources are additive. If they occur, the total tension load can be enough to cause a connection to fracture. Even without connections, the tension can be enough to cause the pipe body itself to fail.

The first source of tension load is trapped expansion force due to the expanded liner being fixed to the outer casing by the compressed rubber seals in the annulus between the liner and the casing. Although these seals are desirable for blocking annulus communication, they are also the problem with the tension load build up. During expansion, the expansion force is locked into the liner and connections between the rubbers because the liner is expanded using a tension constraint. That is, as the expansion cone is being pulled through the liner while the bottom of the liner is fixed to the parent casing, all of the liner between the anchor and the cone is in tension. As the cone passes through each rubber seal, that tension in the liner is trapped and permanent.

A second source for load build up is thermal changes in the wellbore. For example, a wellbore fluid is initially at ambient temperature when it is at the surface. When it goes downhole, it cools the liner which is at the production zone temperature or bottom hole temperature, which may be at 300° F. As the liner is cooled by the wellbore fluid, the liner will tend to shrink in length. However, because the liner is trapped in place by the rubber seals and therefore, cannot shrink in length, the liner will experience a tension load build up that will remain until the temperature goes back up. Conversely, if the temperature is increased (e.g., steam injection), the liner would tend to grow in length. Because it cannot do so as a result of being fixed by the seals, the load experienced by the liner will be a compression load.

A third source for load build up is pressure changes inside the expanded liner. High pressure fluid inside the expanded liner may cause the liner to want to grow circumferentially, which would normally cause a liner to shrink in length. This is often called the Poisson Effect. Again, because the seals or anchors do not allow the liner to shrink in length, a tension load is generated.

Finally, if the liner is blocked off by a plug or ball situated at the bottom of the liner or other sections of the liner, high pressure in the liner may create a downward force (or end thrust) on the plug, thereby generating a tension load in the liner between the plug and the expanded seal that is located above and closest to the plug.

Because these loads are additive, the result is the potential to build up load beyond the connection's ability to resist the load. The total tension load can build up to more than three times the elastic limit or two times the ultimate strength (or point of fracture). These additional tension loads are constant along the length of the liner. Therefore, under these loads, a connection would break in between every pair of external rubber seals.

There is, therefore, a need for an expandable liner capable of handling changes in tension loads. There is also a need for a method of installing an expandable liner to withstand changes in tension loads caused by high pressures.

SUMMARY OF THE INVENTION

In one embodiment, an expandable liner is used to recomplete a wellbore for a re-fracturing operation. The expandable liner may be used to cover the old perforations and provide a larger bore after expansion. The larger bore allows more fracturing fluid to be supplied to the newly perforated zones than would be allowed by an unexpanded liner. In this respect, use of the expandable liner provides a more efficient fracturing operation. Also, the expandable liner may be configured to expand sufficiently to create a small annulus between itself and the parent casing. External seals may be included to provide true isolation.

In one embodiment, an expandable liner is used to recomplete a wellbore for a re-fracturing operation. The expandable liner may be used to cover the old perforations and provide a larger bore after expansion. The larger bore allows the new completion perforations and fracturing operation to be more easily achieved.

In another embodiment, a method of completing a wellbore includes providing an expandable liner having a first end and an anchor at a second end; setting the anchor; expanding the liner while allowing the first end to shrink or grow during expansion; and supplying a fluid into the liner while allowing the first end to shrink or grow in response to the changes in length of the liner. In one embodiment, the fluid is a high pressure fracturing fluid. In another embodiment, the changes in length are caused by changes in temperature.

In yet another embodiment, a method of completing a wellbore includes providing a coiled tubing having an anchor at a first end; setting the anchor; expanding the coiled tubing; perforating the coiled tubing; and supplying a fluid through the coiled tubing. In one embodiment, the method includes conveying the coiled tubing using a second, smaller diameter coiled tubing.

In yet another embodiment, an expandable liner includes an expandable tubular body; an expandable threaded portion welded to each end of the tubular body, wherein the threaded portion has a higher strength than the tubular body. In one embodiment, the expandable threaded end is strengthened using a heat treatment such as a localized quenching and tempering process. In another embodiment, the weld zone of the tubular body may be strengthened using the heat treatment In yet another embodiment, an expandable liner includes an expandable tubular having a threaded connection; two sealing members disposed on the exterior of the expandable tubular and axially spaced apart; a groove formed in the interior of the expandable tubular and between the two sealing members, wherein the groove is configured to fail before the threaded connection fails. In another embodiment, the groove may be formed on the exterior and/or the interior of the expandable tubular.

In yet another embodiment, an expandable liner includes an expandable tubular having a threaded connection. The threaded connection may include a thread section configured to fail at a predetermined tension load; and a sealing section configured to maintain pressure sealing integrity of the threaded connection when thread section fails. The liner may also include two sealing members disposed on the exterior of the expandable tubular and on each side of the threaded connection. In one embodiment, the thread section includes a groove configured to fail at the predetermined tension load. In another embodiment, the thread section includes threads configured to fail at the predetermined tension load. In yet another embodiment, the sealing section includes a seal disposed between a pin portion and a box portion of the connection.

In one embodiment, the expandable liner may have a rib disposed around an outer diameter of the expandable tubular, wherein the rib is configured to form a seal with the outer tubular.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

First Embodiment

In one embodiment, an expandable liner is equipped with an anchor at one end. After setting the anchor, the other end of the liner is allowed to freely move. In this respect, the liner is allowed to shrink and grow in length, thereby preventing build up of tension load in the liner.

Figure 1:
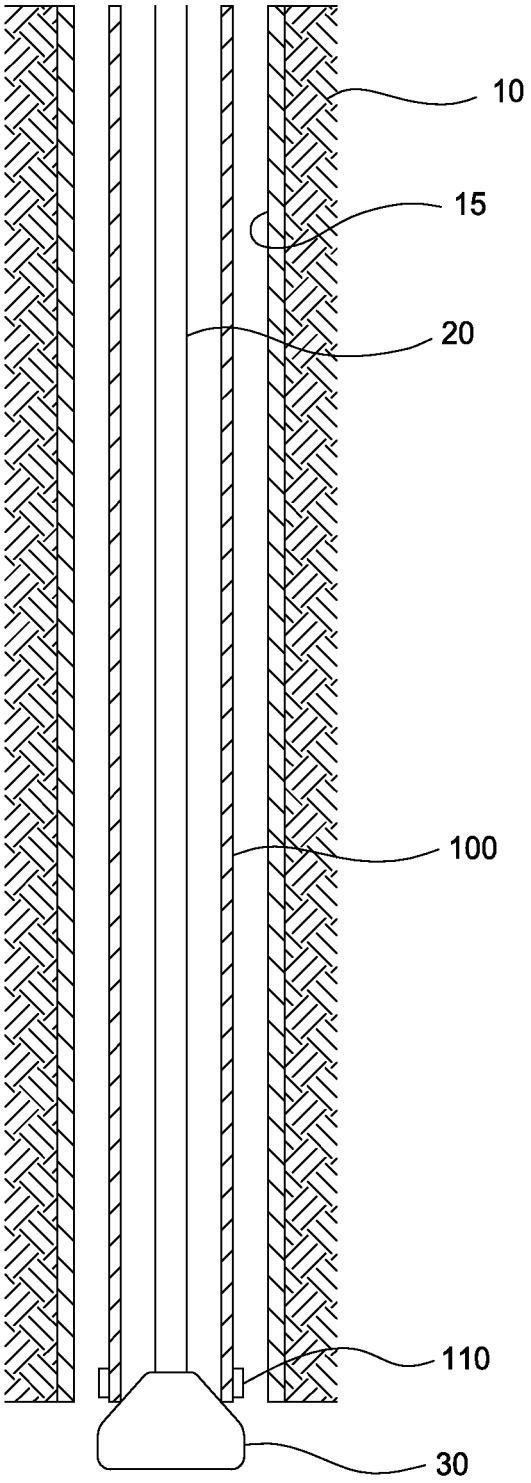
FIG. 1 shows an exemplary embodiment of an expandable liner.

FIG. 1 shows an exemplary embodiment of an expandable liner 100 positioned in a pre-existing wellbore 10. The wellbore 10 may include a casing 15 having perforations (not shown) at one or more locations in the casing 15. The liner 100 is conveyed into the wellbore 10 using a conveying string 20, which may be made up using drill pipe. The conveying string 20 includes an expansion tool 30 at its lower end. The expansion tool 30 is configured to support the liner 100 during run-in. In one embodiment, the lower portion of the liner 100 is partially expanded and rests on the upper surface of the expansion tool 30. An anchor 110 may be provided at a lower portion of the liner 100. In one embodiment, the anchor may be formed by including carbide, elastomer, or both on the liner's outer surface for engagement with the inner surface of the casing 15 upon expansion of the liner 100.

Exemplary expansion tools include a solid cone or an expandable cone. The expansion tool 30 may be mechanically or hydraulically actuated. In one embodiment, the expansion tool 30 may be a hydraulically pumped cone. During operation, the bottom of the liner is sealed so pressure can build up between the cone and the liner bottom. The expansion starts at the bottom of the liner and moves up toward the top of the liner. This type of expansion process does not require any anchors unless there is a desire to retain the liner in a certain location in the wellbore. If needed, one or more anchors may be used to anchor the liner. In another embodiment, the expansion tool 30 is a mechanical cone, as shown in FIG. 1. The cone may be pulled using a jack, the rig, or both. This expansion process also starts from the bottom and moves toward the top. At least one anchor is used at the bottom of the liner to hold the liner in place as the cone is pulled up. In one embodiment, the cone may be selected to minimize the annular area between the expanded liner and the casing. For example, the cone may be selected such that the radial distance between the expanded liner and the casing is less than about 10% of the expanded diameter; preferably, less than about 5% of the expanded diameter. In this respect, use of the expanded liner 100 maximizes the bore size for supplying the fracturing fluid to the new perforations.

Figure 2:
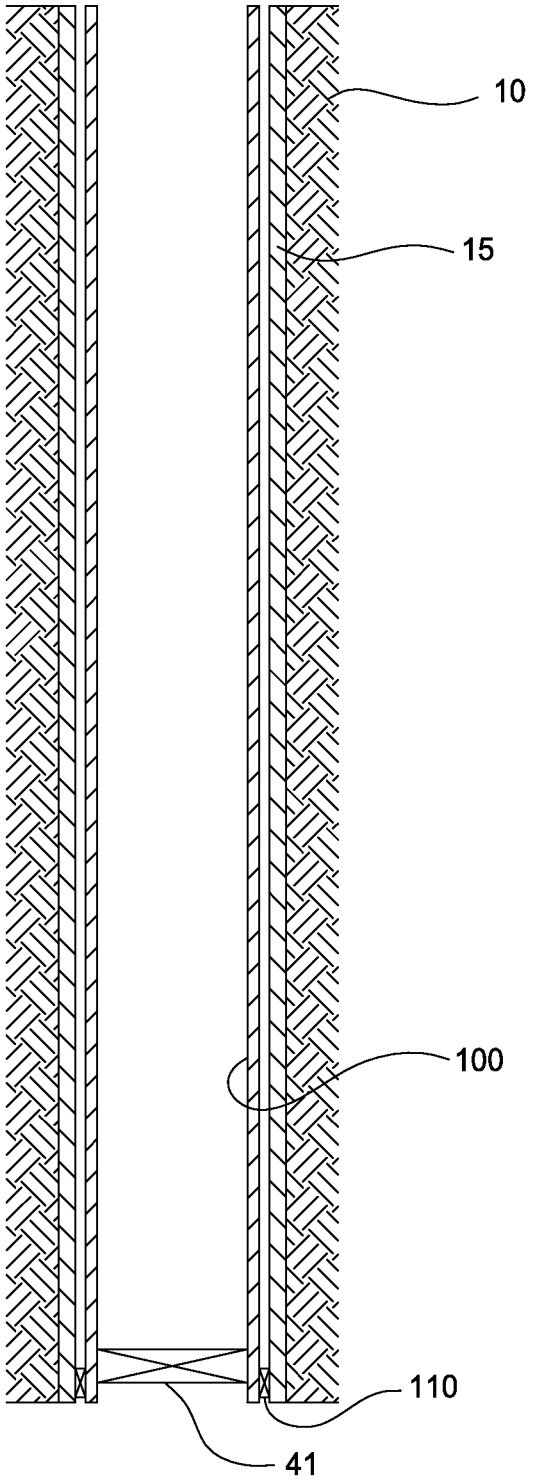
FIG. 2 shows expandable liner of FIG. 1 after expansion.

In operation, the expandable liner 100 may be used in a re-fracturing application of an existing wellbore 10. The wellbore 10 may be a gas well having a long horizontal completion section. Initially, the liner 100 is positioned in the wellbore 10 at the location of interest, as shown in FIG. 1. The conveying string 20 may include a jack for pulling up the cone 30 and expanding the anchor 110 into engagement with the casing 15. In one example, a 3.5 inch liner is used to re-complete the 4.5 inch cased wellbore. The cone 30 may be selected to expand the liner 100 sufficiently such that the radial distance between the expanded liner 100 and the casing 15 is less than about 0.25 inches; preferably, less than about 0.20 inches; more preferably, less than about 0.15 inches. After setting the anchor 110, the rig may be used to pull the cone 30 to expand the remaining portions of the liner 100. In another embodiment, the liner may be expanded using the jack alone. Because only one end of the liner 100 is anchored, the free end of the liner 100 is allowed to shrink during expansion. Additionally, because no seals are used at intermediate locations of the liner 100, tension load generated from the expansion process is not trapped in the liner 100. FIG. 2 shows the liner 100 after expansion.

After expansion, the liner 100 may be perforated in one stage or multiple stages. During the first stage, a plug 41 is set at the bottom of the liner 100 and then the liner 100 is perforated. The liner 100 may be perforated with openings of any suitable shape. For example, the openings may be round or a small slit. An elongated opening such as a slit may facilitate fluid communication from the liner to the casing if the liner length changes during the fracturing operation. After perforation, fracturing fluid is supplied at high pressure and high volume. Because the liner 100 is free at one end, the liner 100 is allowed to shrink or expand in response to temperature changes in the liner 100, the internal pressure increase caused by the fracturing fluid, and the end thrust from the fracturing fluid acting on the plug. As a result, tension load on the liner 100 is not dramatically increased, thereby maintaining the tension load below the liner connection's load ratings during the fracturing process. After completing the fracturing process, a second plug (not shown) may be installed above the first zone, and the process is repeated to fracture another zone. In this manner, the wellbore may be re-completed using the expandable liner 100 and re-fractured using a high pressure, high volume fracturing fluid.

In another embodiment, the liner 100 may optionally include one or more sleeves attached to an outer surface of the liner. The sleeves may limit migration or communication of the fracturing fluid between fracturing sections. The sleeves are configured to barely come into contact with the outer casing during the expansion operation. As such, the sleeve will move with the liner. The sleeves may be made from metal, rubber, or combinations thereof. These sleeves could also be a combination of metal with rubber on the outside that could come into light contact with the outer casing without creating a meaningful amount of anchoring strength. In yet another embodiment, the sleeve may be a combination of metal on the inside and elastomer on the outside. The sleeve will seal against the wellbore upon expansion. However, the metal is configured to shear from the elastomer when a predetermined tension load is reached, such as just below the tension load limit of the expandable connection. After metal separates from the elastomer, the liner is allowed to shrink or grow in response to changes in the tension load.

In another embodiment, the optional step of squeezing the old perforations with cement may be performed before running the liner to maximize the sealing off of perforations. In yet another embodiment, the optional step of pumping a certain amount of cement behind the liner so that as the cone expanded the pipe, the liner is cemented in place.

In another embodiment, the casing can optionally be callipered to determine the average inner diameter of the casing. The measurement can be used to select a cone that will expand the liner as close as possible to the casing. This process will result in a minimal annulus between the liner and the casing. The annulus may get packed off by the fracturing sand during each fracture stage so that a sealing system between the expanded liner and the casing would not be necessary.

Second Embodiment

In another embodiment, a coiled tubing may be used as an expandable liner. Because the coiled tubing does not have any threaded connections, the coiled tubing eliminates the possibility of a threaded connection failure. Use of the coiled tubing as a liner may also significantly increase the burst pressure of the liner and may allow the deployment of the liner in one run.

Figure 3:
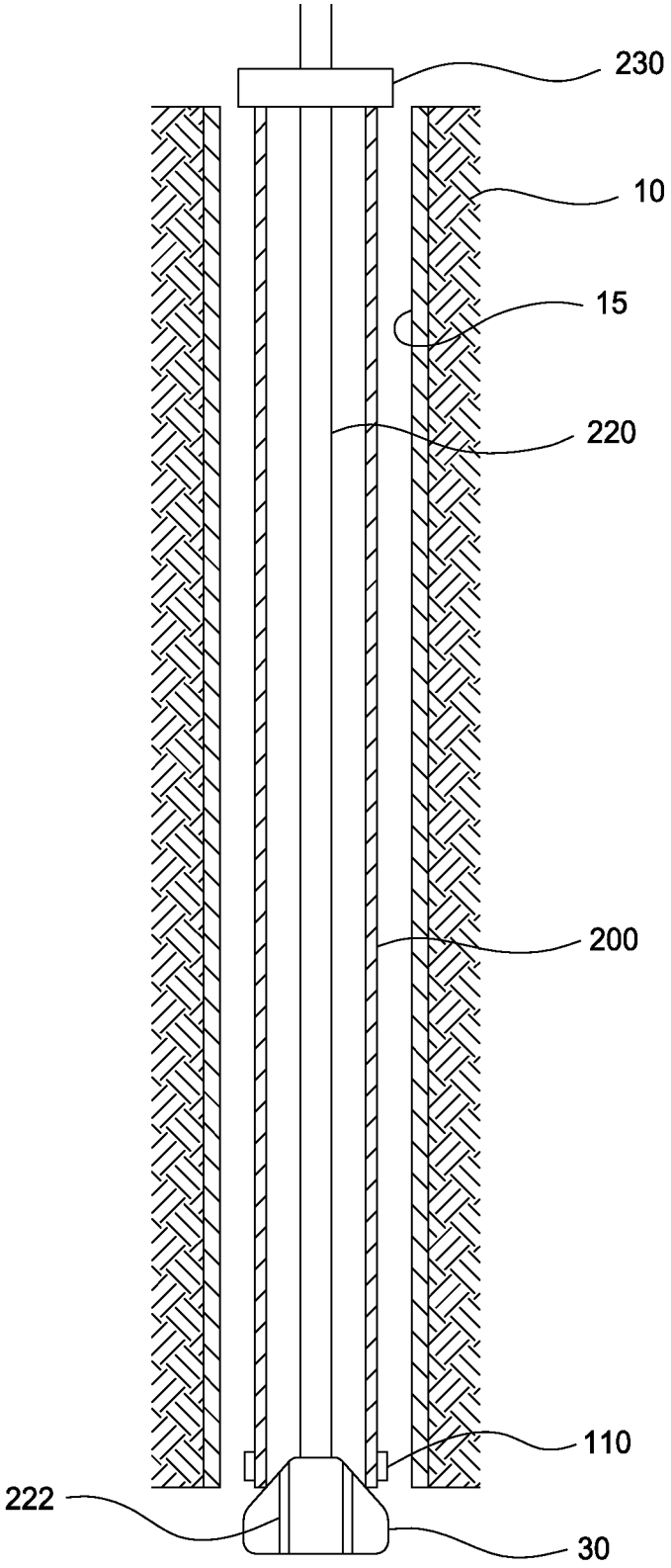
FIG. 3 shows another exemplary embodiment of an expandable liner formed by coiled tubing.

FIG. 3 shows a coiled tubing 200 being used as a liner and positioned in the wellbore 10. The coiled tubing 200 includes an anchor 110 at its lower end. The liner 200 is conveyed into the wellbore 10 using a conveying string 220, which may be a second, smaller sized coiled tubing. The lower end of the conveying string 220 is latched to the cone 30 attached to the lower end of the coiled tubing 200. The cone 30 is configured to support the liner 100 during run-in. In one embodiment, the anchor 100 may be formed by including carbide, elastomer, or both on the liner's outer surface for engagement with the inner surface of the casing 15 upon expansion of the liner 200.

In one embodiment, the cone 30 may be coupled to the bottom of the coiled tubing 200 prior to deployment. Other components necessary to expand the coiled tubing 200 may also be coupled to the coiled tubing 200. An exemplary cone launching assembly is described below with respect to FIG. 15. Other suitable cone launching assemblies are also contemplated In another embodiment, an elastomer may be coated on the outer surface of the coiled tubing 200. For example, the elastomer may be coated on the tubing before coiling. The elastomeric coating would create a seal along the entire length of the liner 200, which may be advantageous over intermittent seal bands when zonal isolation is desired. In one embodiment, the condition of the parent casing 15 may be eroded or damaged so a solid elastomeric sealing member would perform a more reliable seal. One coating thickness could be used for all parent casing weights. In another embodiment, the inner diameter weld flash is removed from the coiled tubing 200. The coiled tubing 200 can be coiled onto a single reel. If additional length is needed a butt weld may be performed to connect two coils at the well site.

In the example shown in FIG. 3, a 3.50 in. coiled tubing 200 may be used to line a 4.5 in. casing 15. The coiled tubing 200 may include an elastomeric coating applied to its outer diameter and the bottom hole assembly including the cone 30 coupled to the liner 200 before being coiled and shipped. The added elastomeric sealing capability on the outside of the expanded liner may prevent fluid communication in the annulus. A carbide anchor 110 at the bottom of the liner 200 may be used to fix the liner bottom to the casing 15.

At the well, the coiled tubing 200 is lowered into the wellbore 10. After the entire length is positioned in the wellbore, the coiled tubing 200 may be deployed by attaching a smaller size coiled tubing 220 as a running string. The size of the running string could be selected based on its tension strength. For example, a 2.000 in. O.D.×0.203 in. wall 100 ksi grade coiled tubing has a tension strength of about 126 kips. In another embodiment, a 2.625 in. O.D.× 0.203 in. wall 100 ksi grade coiled tubing has a tension strength of about 170 kips. The running string 220 could be run inside the liner 200 and latch into the cone 30. The liner 200 would then be run to its proper location for expansion.

Figure 4:
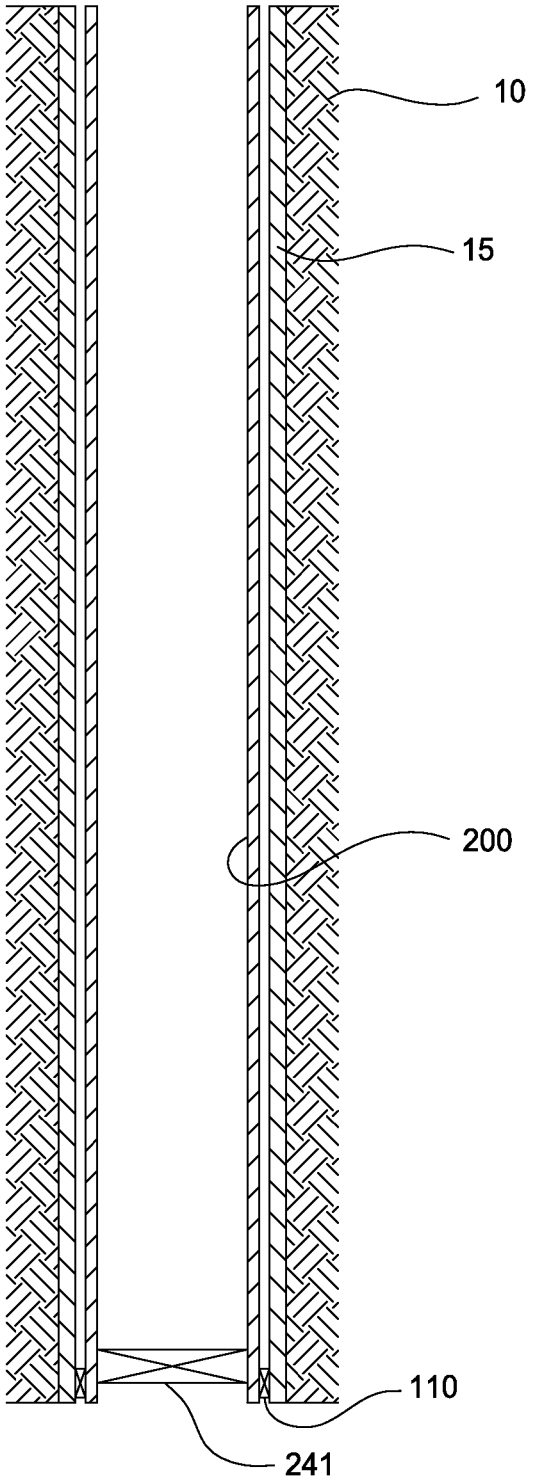
FIG. 4 shows expandable liner of FIG. 3 after expansion.

In one embodiment, a support member 230 is positioned above the liner 200 to prevent the liner 200 from moving up during expansion of the anchor 30. In one embodiment, a packer type system may be set at the liner top to prevent upward movement of the liner 200. The anchor 30 may be set against the casing 15 using pressure from the conveying string 220. Exemplary anchors 30 include an inflatable packer or a mechanical packer. After the anchor 110 has expanded, the coiled tubing unit at the surface may pull the cone 30 through the liner 200 to completely expand the liner 200. FIG. 4 shows the liner 200 after expansion. The packer may be retrieved once the expansion cone cleared the liner. Although mechanical expansion force is typically higher for the coiled tubing 200 than a jointed liner, the coiled tubing unit typically has sufficient power to expand the coiled tubing 200. For example, the coiled tubing unit may apply 200 kips or more to the cone 30. In another embodiment, the liner 200 may optionally be straightened during run-in. After expansion, only the expanded liner 200 remains in the wellbore and no launcher or related devices would need to be retrieved or milled out. An added benefit of coiled tubing liner includes the speed of running the liner and expanding it using coiled tubing units.

After expansion, the liner 100 may be perforated in one stage or multiple stages as described above. In one embodiment, abrasive jet cutting may be used to form a hole or slot in the liner 200. This perforation process may include setting a packer 241 and then perforating the liner using an abrasive jet. After perforation, the liner 200 may be fractured as described above. Thereafter, the packer is unset and move up to the next zone of perforation to repeat the process.

In yet another embodiment, a second anchor may be provided at the top of the liner 200 to fix the liner in the casing after expansion. In another embodiment, a filter may be provided at the top of the liner to prevent sand movement but allow permeability through the annulus at the upper end of the liner 200. The filter may be selected from steel wool, screen, or combinations thereof.

In another embodiment, the casing can optionally be callipered to determine the average inner diameter of the casing. The measurement can be used to select a cone that will expand the liner as close as possible to the casing. This process will result in a minimal annulus between the liner and the casing. Instead of an elastomer coating, the annulus may get packed off by the fracturing sand during each fracture stage so that a sealing system between the expanded liner and the casing would not be necessary.

In another embodiment, a shaped cone may optionally be used that eliminated any high contact pressures between the cone and the liner. Optionally, a fluid, such as a fracturing fluid, may be treated to act as a lubricant to prevent galling the cone. In another embodiment, the cone may be configured to allow fluid inside of the liner to pass through the cone during expansion. For example, the fluid may traveled through one or more fluid bypass 222 in the cone. In another embodiment, lubrication by a porting system on the cone would decrease the probability of galling. In yet another example, the inner diameter of the liner may be coated to reduce friction during expansion.

Many advantages may be realized in using coiled tubing as the expandable liner. First, coiled tubing has no threaded connections so no significant weak point. Second, coiled tubing can be made in any size needed for a typical re-frac application, and can be made more than twice as strong as the pipe used in threaded expandable liners. Third, coiled tubing can be expanded by using an inner string that is also a coiled tubing. In this respect, the expansion is smooth and steady without the need to stop often to stand back two or three joints as the work string comes out of the well. Fourth, the coiled tubing may be electric resistance welded, which means the wall thickness is exactly the desired thickness and the outer diameter of the coiled tubing can be made exactly to the desired diameter. Fifth, coiled tubing is extremely high grade metallurgy because of its need to be fatigue resistant. Sixth, the expanded coiled tubing can withstand the high pressures and tension loads generated in a typical re-completion/re-frac operation without plastically deforming. Seventh, deployment of the expandable liner is much faster.

Third Embodiment

In another embodiment, the expandable liner may include a high strength connection. Exemplary stronger connections include connections with higher efficiency and connections made with a stronger material. For example, the stronger material may be P-110 grade versus a normal material such as L-80 grade.

Figure 5:
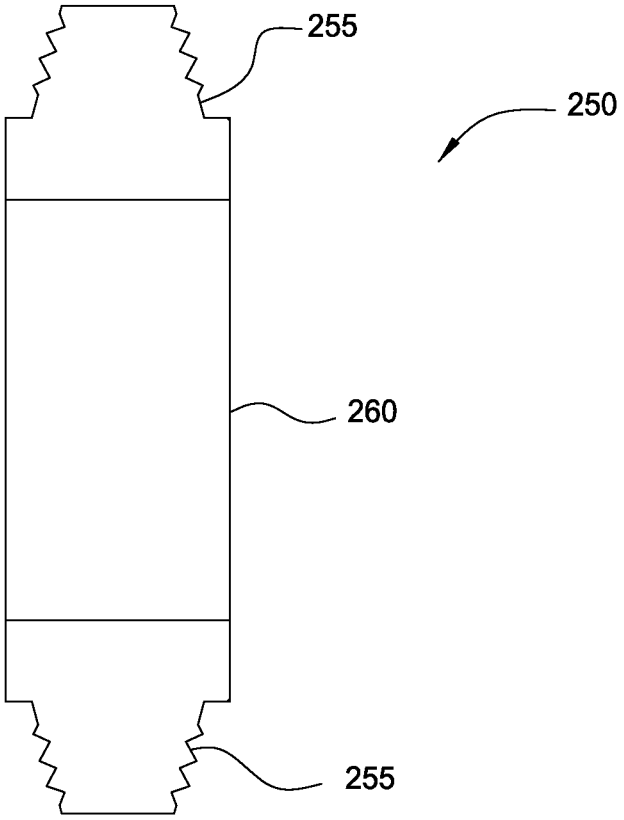
FIG. 5 shows an exemplary embodiment of a high strength connection for use with an expandable liner.

FIG. 5 shows an embodiment of an expandable tubular 250 having a stronger connection 255 at each end of a tubular body 260. In one embodiment, a stronger connection can be machined onto a higher strength material that has been welded to a tubular body. In another embodiment, the stronger connection can be machined onto an end of the tubular body that was modified to a higher strength by an adequate Heat Treat method, such as a quenching and tempering localized process.

The higher strength material can be welded to the tubular body using any suitable method. In one embodiment, the welding method may allow the higher grade ends to be welded to the tubular body without leaving rams horns at the welded sections, thereby eliminating the need to remove excess material from the outside and the inside. An exemplary welding technique is a clean electric induction welding method developed by Spinduction Weld Inc., located in Calgary, Canada.

It is believed that by increasing the strength of the tubular ends to P-110 strength, a gain of about 37.50% strength will be immediately created over the original L-80 material. The expanded material could also exhibit additional stronger properties due to the radial expansion, which in itself is actually cold working the expanded material and adding to its strength. This expansion process may cause the material strength of the P-110 material to gain additional strength, thereby resulting in a material that may exhibit 40% higher strength than that of the original L-80 material.

In operation, the higher strength connection may prevent the connections from parting in response to tension load changes. Thereafter, the expanded liner string can be perforated at optimal locations as desired.

Fourth Embodiment

Figure 6:
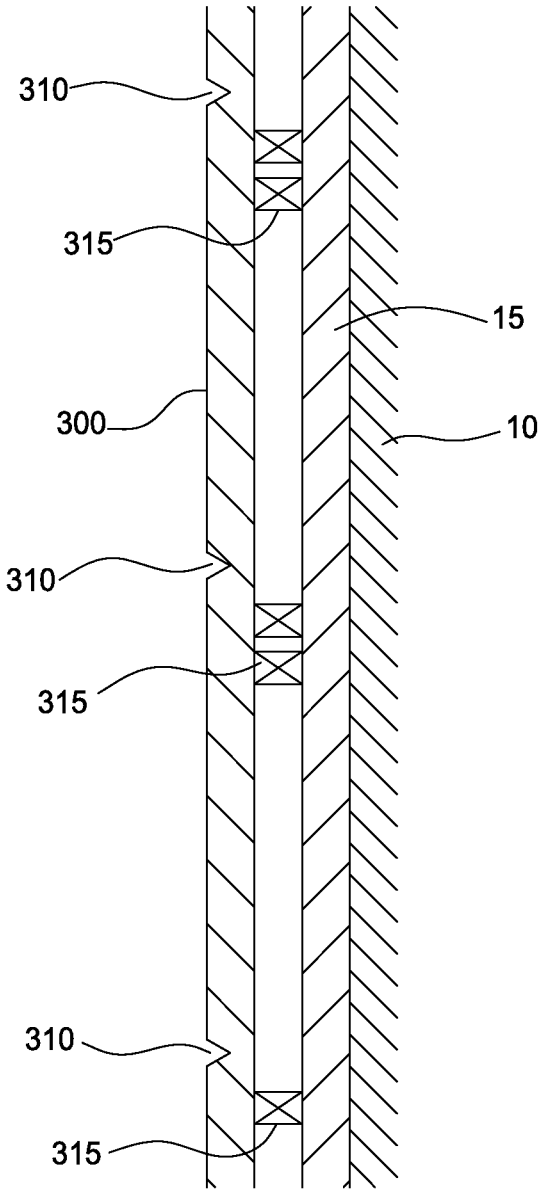
FIG. 6 shows another exemplary embodiment of an expandable liner.

In another embodiment, an expandable liner may include a tension failure groove that would allow the liner to fracture at a designated point in each frac stage section. FIG. 6 illustrates a partial view of the expandable liner 300 after being expanded against the casing 15. External sealing members 315 are used to prevent fluid communication between different sections of the wellbore 10. As shown, a groove 310 is machined in the liner section between the sealing members 315. The grooves 310 are designed to fail before the connections fail. Although the grooves 310 are shown at the lower end of each liner section, it is contemplated that the grooves 310 may be machined in any suitable location in the liner section. Also, the grooves 310 may be machined in the inner diameter or the outer diameter of the liner 300. The grooves 310 may be placed at a location where the failure would do the least harm. A narrow groove failure would ensure a connection failure did not leave sections of a connection protruding into the wellbore. When the groove 310 is inside the liner 300, the fractured section would be as far away from the liner bore as possible, thereby minimizing the chance of any jagged pipe being inside the liner bore.

Fifth Embodiment

In another embodiment, the expandable liner 350 may include a shearable connection 360 that will seal internal pressure after the connection 360 shears. The connection 360 may be selectively placed to control the location of the failure.

Figure 7:
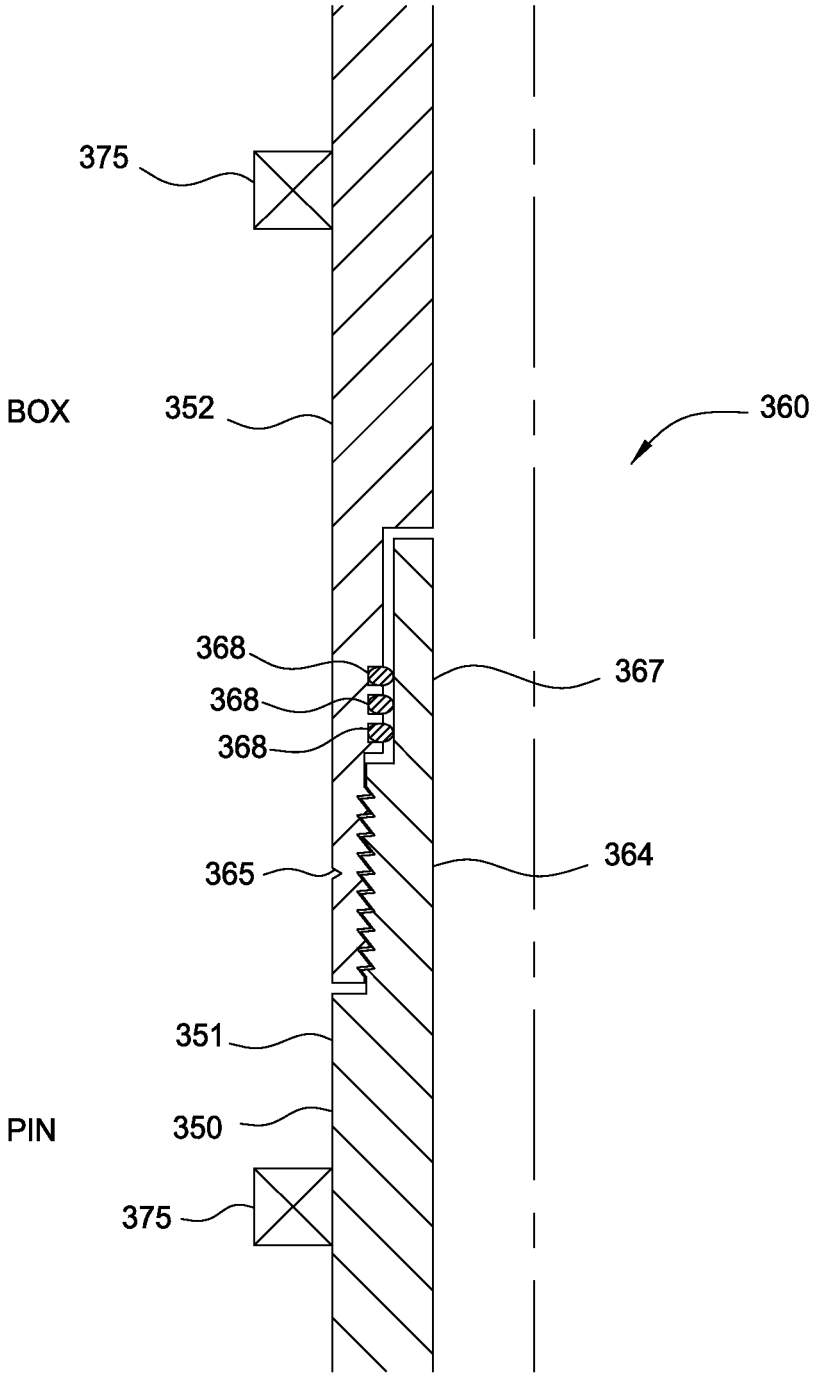
FIG. 7 shows an exemplary embodiment of a shearable connection for use with an expandable liner.
Figure 11:
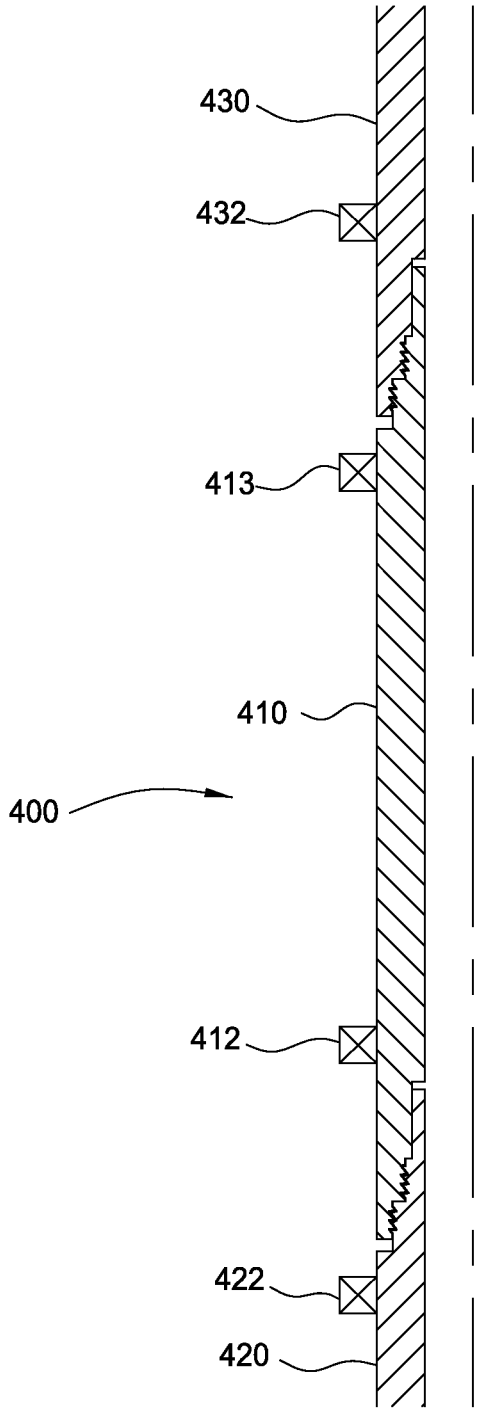
FIG. 11 shows another exemplary embodiment of an expandable liner equipped with external seals.

As shown in FIG. 7, this embodiment include a threaded connection 360 having a pin portion 351 on one joint of the liner threadedly connected to a box portion 352 of another joint of the liner. The connection 360 will have a tension strength that is less than the liner, such as 50% as strong as the liner. The connection 360 includes a groove 365 configured to shear at a predetermined tension load, such as just below the tension load rating of a normal thread connection. The groove 365 is formed on the exterior of the thread section 364 of the connection 360. As shown, the thread section is a one-step thread connection. In another embodiment, the thread section can be a two-step thread connection (as shown in FIG. 11) or a tapered, thread connection. The thread connection 360 also includes a sealing section 367. The sealing section 367 includes a series of o-ring seals 368 disposed between the pin portion 351 and the box portion 352 to prevent fluid communication. One or more seals 375 may be disposed on the exterior of the liner 350 for engagement with the casing upon expansion. The sealing section 367 may be used with any suitable type of thread connection.

Figure 8:
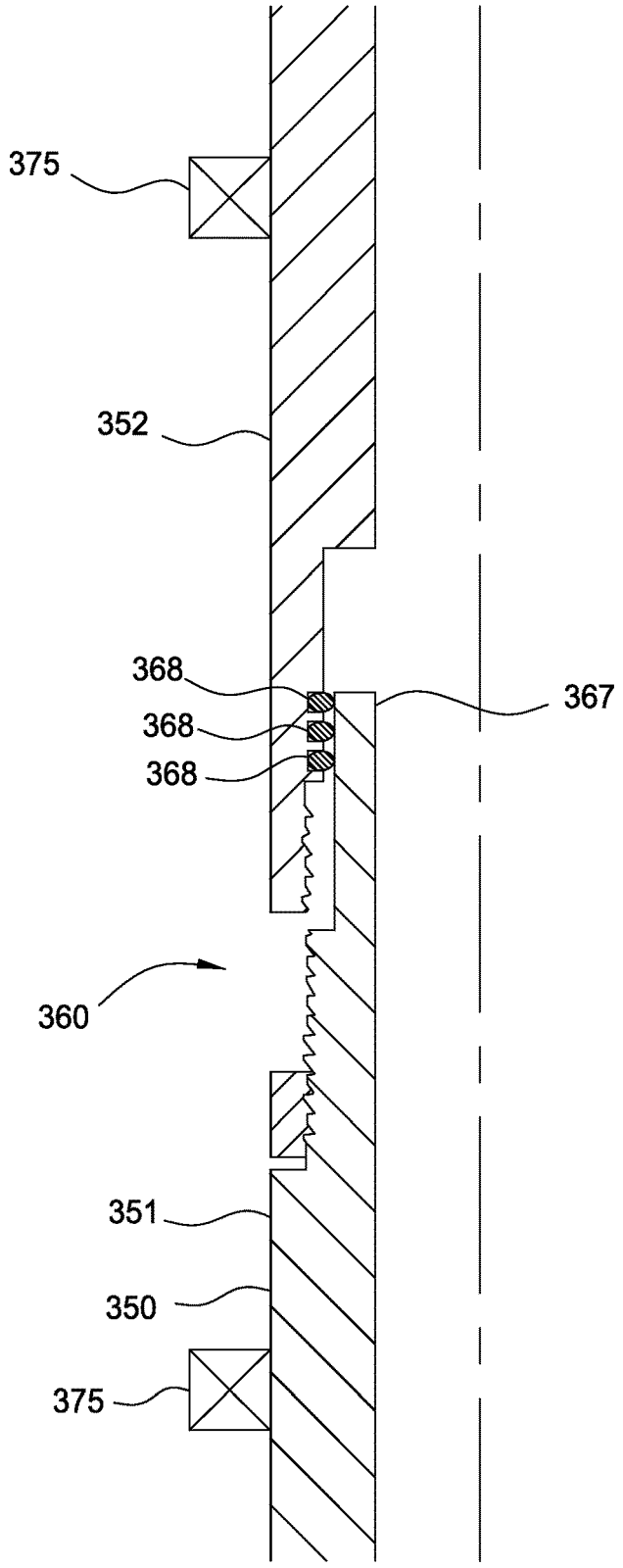
FIG. 8 shows the connection of FIG. 7 after breakage.

After expansion, the expansion tension load is trapped by the seals 375 engaged to the casing 15. During the fracturing operation, the tension load experienced by the connection 360 may reach above the predetermined tension load. When that occurs, the groove 365 will shear to allow separation of the connection 360 due to changes in length, as shown in FIG. 8. The pressure integrity is maintained by at least one of the series of o-ring seals 368 that remain engaged after the connection 360 fractures. In one example, the series of o-rings 368 and recesses for housing the o-rings 368 are spaced about 0.5 in. apart. Any suitable number of o-ring seals 368 may be used so long as the seals 368 remain engaged after shrinkage of the joint of liner 350. For example, the connection 360 many include two, four, or five o-ring seals 368. A typical joint of liner 350 could be 40 feet long, and thermal cooling of 150° F. may cause the joint to shrink in length by about 0.50 in.

Figure 9:
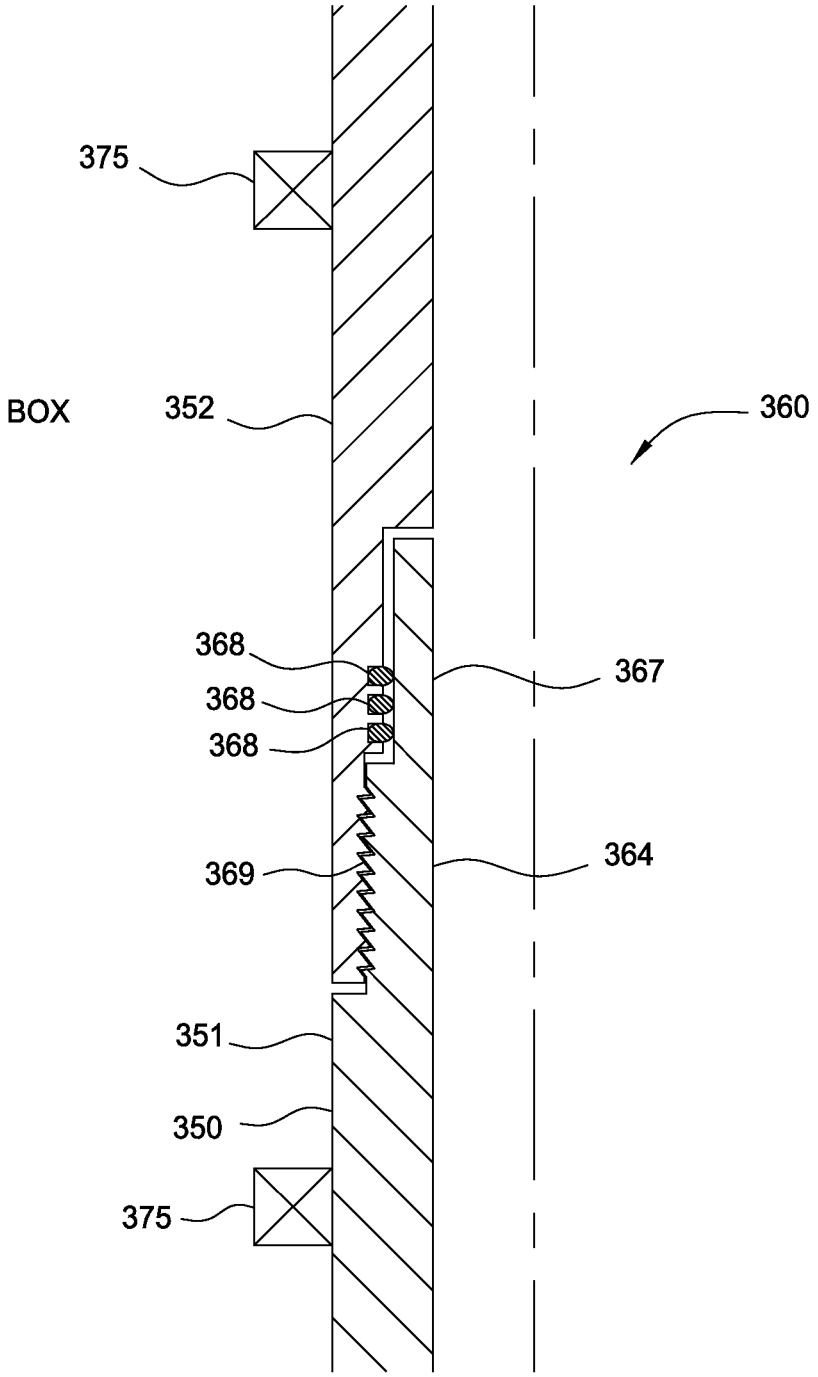
FIG. 9 shows another exemplary embodiment of a shearable connection for use with an expandable liner.
Figure 10:
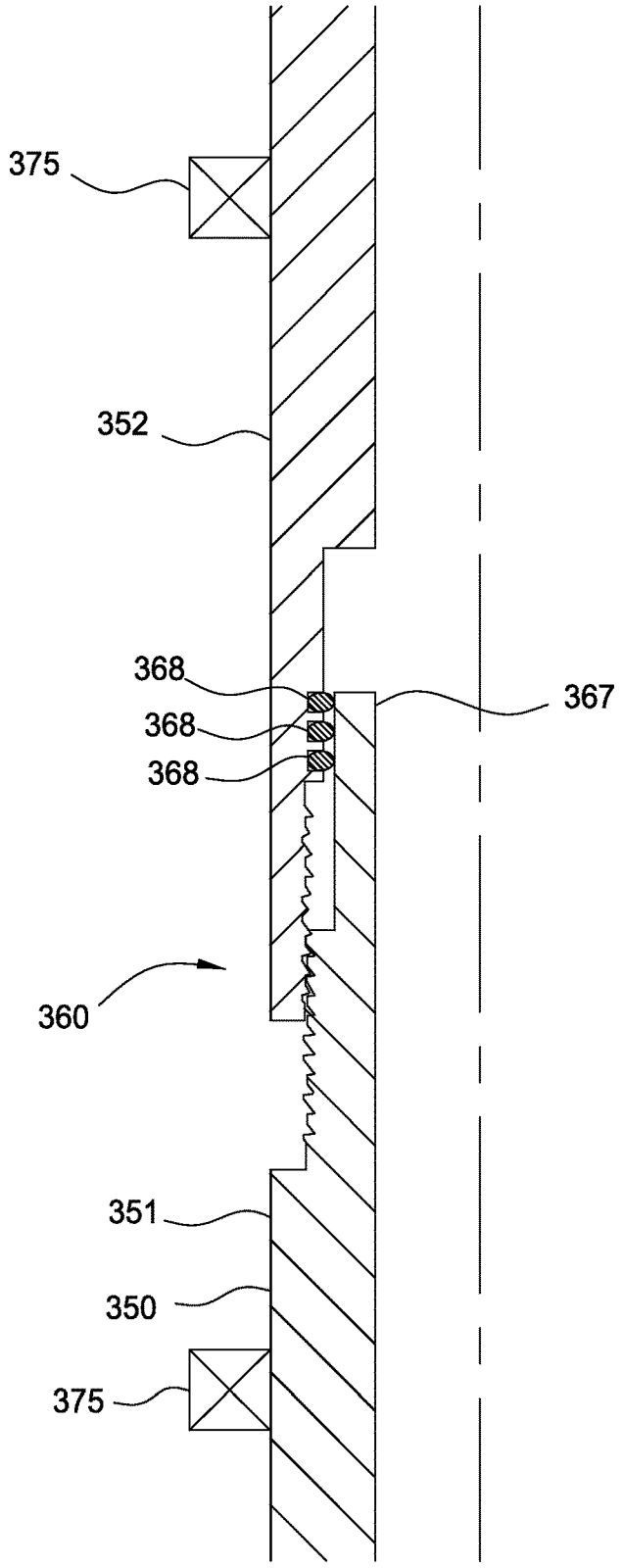
FIG. 10 shows the connection of FIG. 9 after breakage.

In another embodiment, as shown in FIG. 9, instead of forming the groove in the connection 360, the threads 369 may be configured to shear at the predetermined tension load. When the predetermined tension load is reached, the threads will fail to allow relative axial movement between the pin portion 351 and the box portion 352 due to shrinkage. FIG. 10 shows the connection 360 after the threads shear. Although the pin portion 351 and the box portion 352 have moved away from each other, at least one of the seals 369 remain engaged to maintain pressure integrity.

In one embodiment, each joint of liner 350 may be fixed at both ends to the casing 15, such as using external rubber seals 375 that are trapped between the liner 350 and the casing 15. The connection 360 in between the rubber seals 375 may be designed to fail. This configuration may keep the connection 360 opening to about 0.50 in.

If a section of expanded liner includes external rubber seals at each end, the shearable connection could be placed so that the fracture occurred in the best location. For example, if ten joints are connected in the liner section, the total shrinkage may be ten times, or 5 inches. Thus, the pieces of the connection that come apart would separate by the same amount. In this configuration, the seals would need to remain engaged after 5 inches of axial separation.

Referring back to FIGS. 7 and 8, the seals 375 are shown positioned on each side of the threads. It is contemplated that the seals 375 may separated from each other at any suitable distance. In one embodiment, the two seals 375 are positioned relatively close to the threads. In this position, the short distance between the seals 375 means that the connection will have a small change in length during the fracturing operation. Also, the distance from one of the seals 375 to another seal at an opposite end of the same liner joint would be long. In this respect, a longer length of liner is fixed and cannot change in length. Therefore, the longer length of liner may help maintain alignment of the perforations during fracturing. In another embodiment, the two seals 375 are positioned relatively far away from the threads, for example, more than 25% of a length of the liner joint. In this position, the longer distance between the seals 375 would mean that the connection will have a bigger change in length during the fracturing operation. As a result, more of the liner will experience a smaller tension load during fracturing.

Sixth Embodiment

FIG. 11 shows a liner 400 having a joint 410 connected between two other joints 420, 430. A plurality of rubber seals 412, 413, 422, 432 are disposed on the exterior of the joints and relatively close to the threaded connections. As shown, the threaded connection includes a two-step thread type section, although any thread type connection may be used. Even though only two seals 412, 413 are shown with joint 410, each joint 410, 420, 430 may be provided with any number of seals. In one embodiment, the casing can optionally be callipered to determine the average inner diameter of the casing. The measurement can be used to select a cone that will expand the liner as close as possible to the casing. This process will result in a minimal annulus between the liner and the casing. In operation, the liner 400 would be fixed at each seal location after expansion. The pipe section of a joint 410 between two seals 412, 413 would be sufficiently strong to withstand the total tension load without failing. Because joint 410 is fixed by the seals 412, 413, the distance of the pipe section between the seals 412, 413 cannot change in response to changes in wellbore conditions such as temperature changes. As a result, the perforations in the joint 410 would remain aligned with the perforations of the parent casing.

Seventh Embodiment

In another embodiment, the expandable liner may be coated with a sealing material on a substantial portion of its exterior surface, for example, at least 80% of its exterior surface. Upon expansion, the coating would fix the liner to the parent casing, thereby ensuring the perforations in the liner and the parent casing would remain aligned. Also, the coating function as anchors for the connections in the liner, thereby strengthening the connections' resistance to tension load buildup.

Eighth Embodiment

Figure 12:
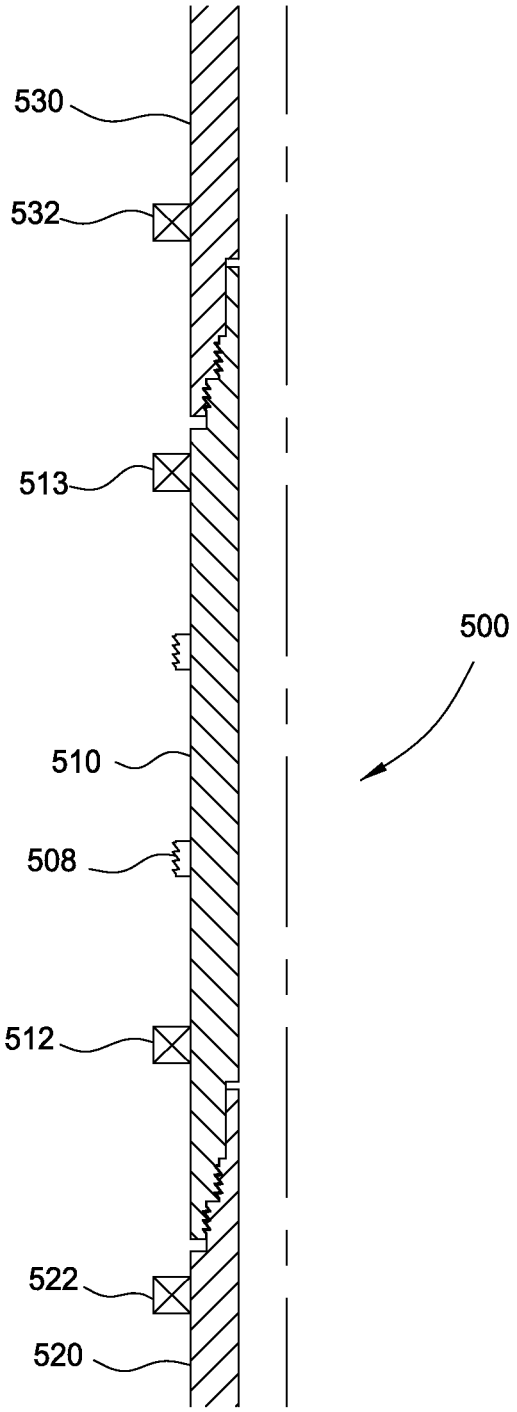
FIG. 12 shows another exemplary embodiment of an expandable liner equipped with an anchor.

FIG. 12 shows a liner 500 having a joint 510 connected between two other joints 520, 530. As shown, the threaded connection is a two-step thread type section, although any suitable thread type connection may be used. An anchor 508 may be disposed on the exterior of one or more of the joints 510, 520, 530 of the liner 500. For clarity, FIG. 12 only shows the anchor 508 on the middle joint 510. An exemplary anchor may include a plurality of carbide pieces disposed on the exterior of the joint 510. In one embodiment, the anchor may be 3 inches to 6 inches in length, or any suitable length to sufficiently hold the liner 500 against the casing. During expansion, the carbide may penetrate the outer diameter of the liner 500 and the inner diameter of the casing, thereby holding the liner 500 to the casing. In use, after the liner 500 is radially expanded in place inside the casing, perforations may be made which penetrate both the liner 500 and the casing. A stimulation treatment, such as a fracture stimulation, may then be carried out, in which fluids are pumped through the perforations of both the liner 500 and the casing. Therefore it is important that the perforations in both the liner 500 and the casing remain substantially aligned. Pumping stimulation treatments, particularly at high volumetric flow rates and at high pressures, may create forces on the liner 500 tending to encourage the liner 500 to shrink axially. Such forces may be experienced by a plurality of liner joints 510 connected together; however, each individual liner joint 510 may be anchored to the casing by anchors 508. In this case, each liner joint 510 may experience large axial tensile loads at each connection with a corresponding liner joint 510. In the event the connections fracture (for example by failure at the threads) due to such loads, the anchor 508 will retain the expanded joints 510 substantially in place, thereby substantially maintaining alignment of the perforations in the liner 500 with the perforations of the parent casing.

In another embodiment, the liner 500 may optionally include a plurality of seals 512, 513, 522, 532 disposed on the exterior of the joints and relatively close to the threaded connections. Even though only two seals 512, 513 are shown with joint 510, each joint 510, 520, 530 may be provided with any number of seals. In another embodiment, one or more seals may be positioned in close proximity to the anchor 508. In operation, the liner 500 would be fixed by the anchor 508 after expansion and the two seals 512, 513 of the joint 510 would prevent fluid communicate through the annulus between the joint 510 and the casing. In one embodiment, the seals 512, 513, 522, 532 may be made of rubber or elastomer. In another embodiment, the seals may be positioned 4 inches to 6 inches away from the threaded connection, or any suitable distance to sufficiently close off fluid communication after the connection fractures.

Ninth Embodiment

In another embodiment, an expandable liner may include a tension failure groove that would allow the liner to fracture at a designated point in each frac stage section. In one embodiment, the expandable liner 550 may include a shearable connection 560 that is selectively placed to control the location of the failure.

Figure 13:
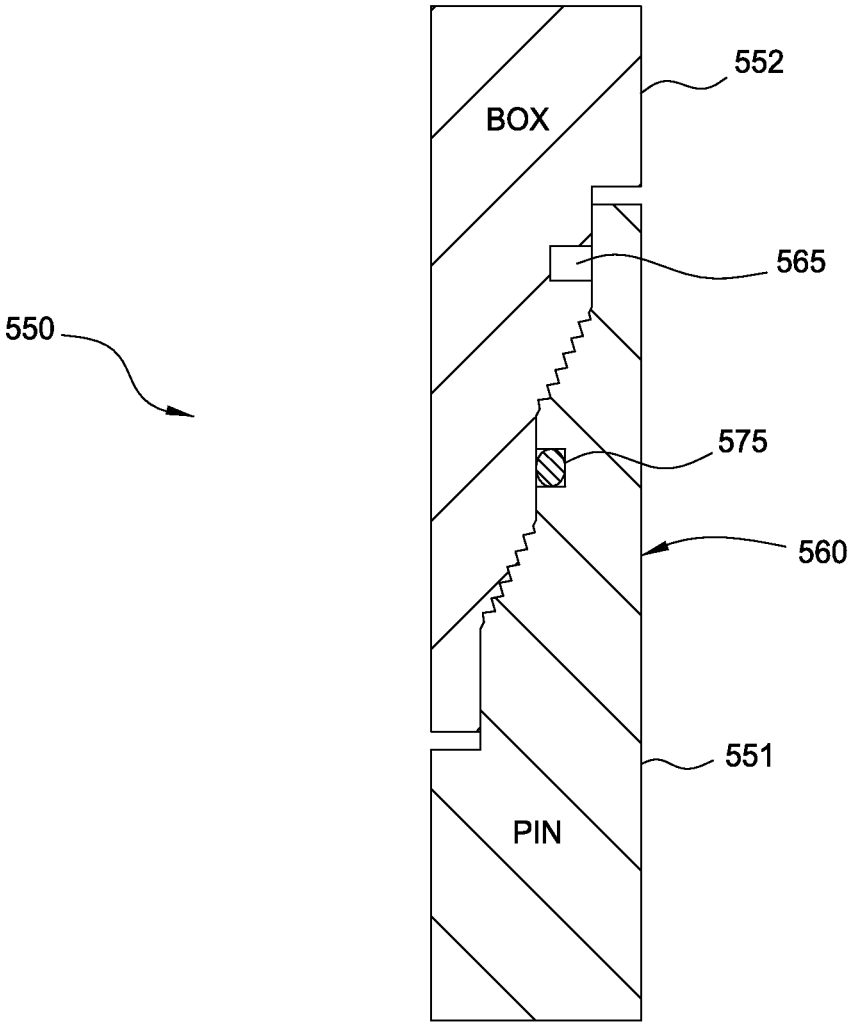
FIG. 13 shows another exemplary embodiment of a shearable connection for use with an expandable liner.

As shown in FIG. 13, the liner 550 includes a threaded connection 560 having a pin portion 551 on one joint of the liner threadedly connected to a box portion 552 of another joint of the liner. The connection 560 includes a fracture groove 565 configured to shear at a predetermined tension load, such as just below the tension load rating of a normal thread connection. The groove 565 is formed on the box portion 552 and inside the connection 560. As shown, the groove 565 is located below the most inward engaged threads and inside the box portion 552 that is protected by the nose of the pin portion 551. The groove 565 creates a smaller cross-section in the box portion 552. The groove 565 is designed to be the weakest section of the threaded connection 560. In one embodiment, the groove 565 can be 0.05 inches to 0.4 inches wide, and preferably, 0.15 inches to 0.25 inches wide. In one embodiment, the thread connection 560 is a two-step thread connection. In another embodiment, the thread connection can be a one-step thread connection, a tapered, thread connection, or any suitable connection.

In another embodiment, the thread connection 560 may optionally include one or more seals 575 from FIG. 13 or 368 from FIGS. 7-10. An exemplary seal 575 may be an o-ring seals disposed between the pin portion 551 and the box portion 552 to prevent fluid communication. For example, the seal 575 may be located between the threads of a two step thread connection 560. In one embodiment, a series of seals 575 may be used, so long as the seals 575 remain engaged after shrinkage of the joint of liner 550. For example, the connection 560 many include two, four, or five o-ring seals 575.

After expansion and during the fracturing operation, the tension load experienced by the connection 560 may increase above the predetermined tension load. When that occurs, the groove 565 will shear box portion 552 and allow the connection 560 to separate. The pressure integrity is maintained by the seal 575 that remains engaged after the connection 560 fractures.

It is contemplated that features of any embodiment described herein may be used with any other embodiment. For example, each joint of liner 550 may be fixed at both ends to the casing 15, such as using the anchor 508 and/or the seals 512, 513 shown in FIG. 12. The anchor 508 and seals 512, 513 may limit separation of the connection 560, for example, to about 0.50 inches.

Tenth Embodiment

Figure 14:
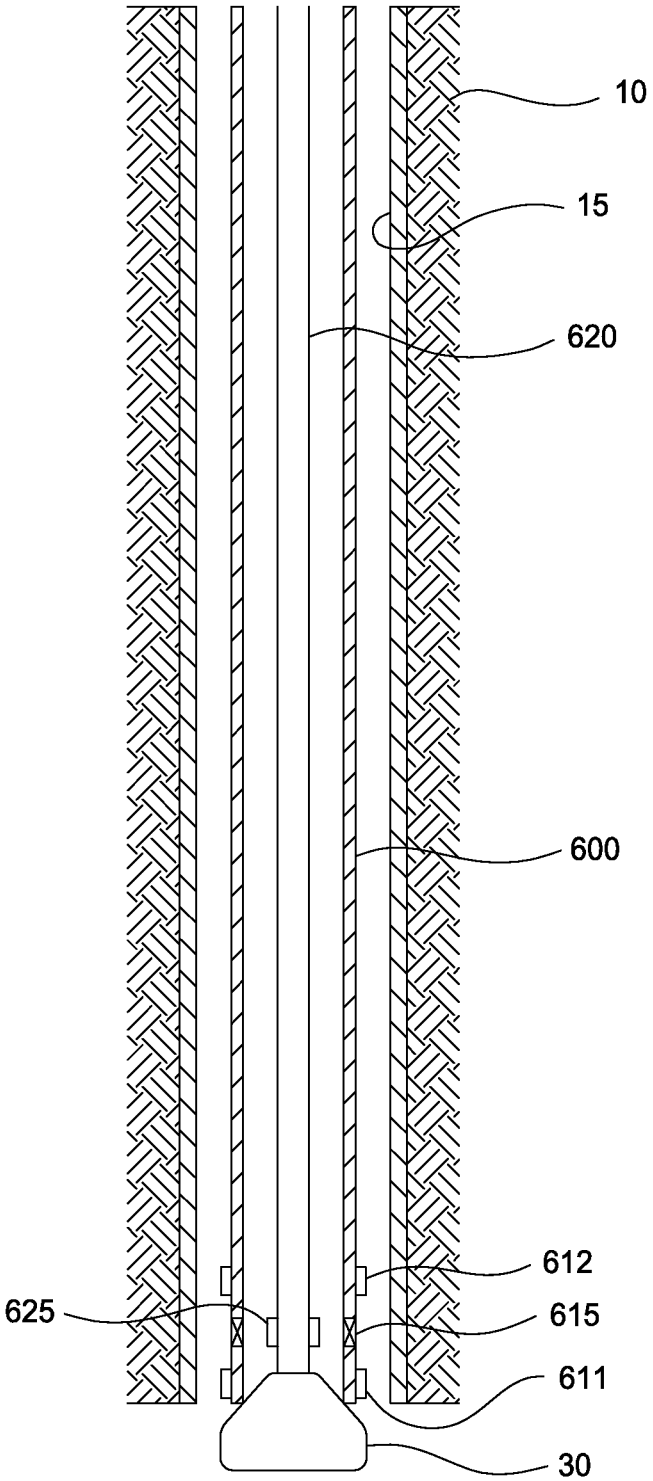
FIG. 14 illustrates another embodiment of an expandable liner having anchors for securing the expandable liner.

FIG. 14 illustrates another embodiment of an expandable liner 600 having anchors for securing the expandable liner 600 prior to the expansion process. In this embodiment, a coiled tubing is used as the liner 600 and a smaller diameter coiled tubing is used as the conveying string 620. The liner 600 is shown positioned inside the casing 30. The lower end of the liner 600 may include a first anchor 611 and a second anchor 612. The first and second anchors 611, 612 may be a carbide anchor. A temporary anchor 615 may be disposed between the first and second anchors 611, 612. The temporary anchor 615 may be set to temporarily hold the liner 600 in the casing 15 until the first anchor 611 is set. In one embodiment, the temporary anchor 615 may be a thinner wall section, a slotted wall section, or a thinner, slotted wall section in the liner 600. The temporary anchor 615 may be set using an inflatable expander 625. The inflatable expander 625 may be an inflatable packer that is actuatable by the fluid pressure from the conveying string 620. In another embodiment, carbide may be provided on the exterior of the temporary anchor 615, such as between slots of a slotted anchor.

In operation, the inflatable expander 625 may be actuated to expand the temporary anchor 615. After expansion, the inflatable expander 625 is deflated. Thereafter, the conveying string 620 is pulled to pull the cone 30 through the liner 600. The temporary anchor 615 is configured to resist the expansion force, thereby allowing the cone 30 to be pulled through the first anchor 611. Initially, the cone 30 expands the first anchor 611 against the casing 15, then the cone 30 travels under the temporary anchor 615, and then the cone 30 expands the second anchor 612 against the casing 15. The first and second anchors 611, 612 prevent the temporary anchor 615 from being exposed to tension loads sufficient to cause failure of the temporary anchor 615.

Eleventh Embodiment

Figure 15:
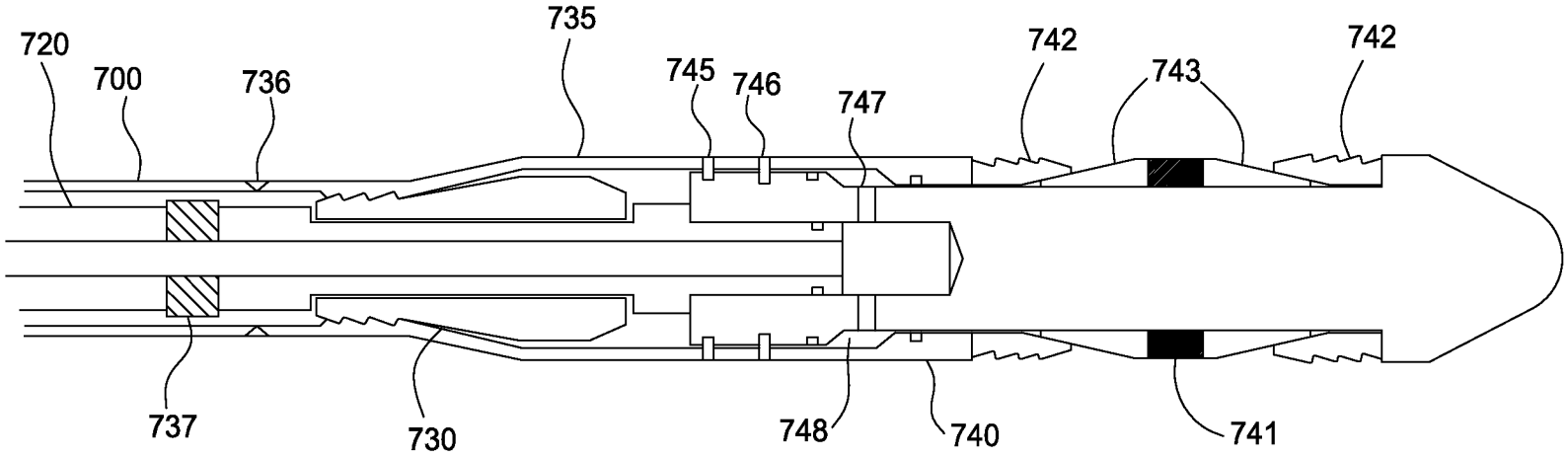
FIG. 15 shows an exemplary embodiment of an anchor for use with an expandable liner.

In another embodiment, the liner 700 may include a casing anchor for securing the liner 700 against the casing 15 prior to expansion. As shown in FIG. 15, the casing anchor may be a packer or bridge plug 740 attached to the liner 700 via a sleeve 735. The casing anchor may be configured to be easily drillable, for example it may be manufactured from plastics, composite materials, aluminum, or any other suitable material known in the art. Alternatively, the casing anchor may be selected to remain permanently in place, and may be manufactured from a different material, such as steel. The sleeve 735 may be attached to the liner 700 using a weld connection 736. The sleeve 735 is large enough to accommodate the expansion cone 730 and is strong enough to withstand the expansion force. The packer 740 is disposed below the cone 730 and attached to the sleeve 735 using connecting pins 745 and setting shear pins 746. The packer 740 includes a sealing element 741 such as an elastomer and a cone 743 and slips 742 on each side of the sealing element 741. The packer 740 may be actuated by supplying fluid pressure through setting ports 747 to a chamber 748 defined by the sleeve 735 and the packer 740.

In operation, the packer 740 is pre-assembled with the cone 730 and liner 700 and lowered into the wellbore. Fluid is supplied down the work string 720 and out of the setting ports 747. The pressure in the chamber 748 increases sufficiently to shear the pins 745, 746 and cause the packer 740 to move up. As a result, the slips 742 and cone 743 compress and expand the sealing element 741 against the casing 15 and set the slips 742 against the casing 15, thereby securing the liner 700 to the casing 15. The work string 720 may now be pulled to pull the cone 730 through the liner 700 to expand the liner 700. The cone 730 will also expand any anchors on the liner 700. After expansion, the casing anchor will not be un-deployed and can be used as the first frac plug during the fracturing operation. Once the casing anchor is set, optional pressure ports may be opened so that the liner 700 can be expanded without fluid trapped inside.

Twelfth Embodiment

In another embodiment, the liner 700 may include a bottom trip anchor for securing the liner 700 against the casing 15 prior to expansion. In one embodiment, the anchor may be expanded by a mechanically set packer, such as the packer shown in FIG. 15. In this embodiment, the packer is attached to the bottom of the work string 720 and positioned adjacent the anchor. During operation, the liner 700 is set down on an object such the bottom of the wellbore or a previously set bridge plug. The set down force would cause the packer to expand, which in turn, expands the bottom trip anchor against the casing.

Thirteenth Embodiment

Figure 16:
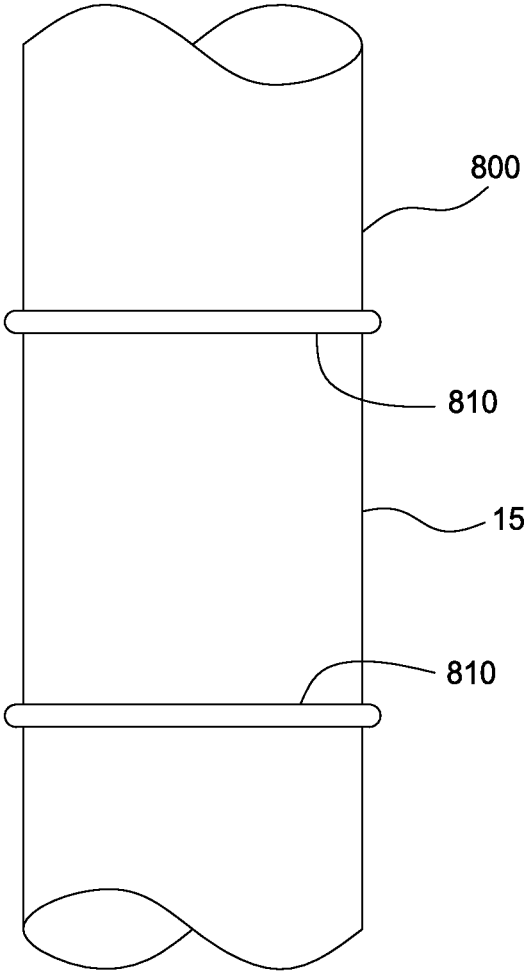
FIG. 16 illustrates an exemplary embodiment of an expandable liner.

FIG. 16 illustrates an embodiment of a liner 800 configured to minimize fluid flow through the annulus after expansion. As shown, the liner 800 has been expanded and is adjacent the casing 15. The liner 800 may be a coiled tubing or a jointed tubular such as casing. The liner 800 includes one or more metal ribs 810 disposed around the outer diameter of the liner 800. In one embodiment, ribs 810 may be disposed on the liner 800 every 50 feet to 400 feet, and preferably every 100 feet to 200 feet. In one embodiment, the ribs 810 can be weld beads that extend about 0.7 inches to 1.3 inches along the axial length of the liner 800, and 0.1 inches to 0.25 inches raised above the outer surface of the liner. In another embodiment, the ribs 810 can extend along the axial length of the liner 800 for about 0.5 inches to 2 inches, or about 0.5 inches to 5 inches. The metal ribs 810 are expanded into contact with the inner diameter of the casing 15. Such contact may create a metal contact seal to prevent fluid flow through the annulus between the liner 800 outer diameter and the casing 15 inner diameter. Alternatively, such contact may be an incomplete seal, but may serve to significantly restrict fluid flow along the interface between the liner and the casing. Because the metal ribs 810 are bonded to the liner 800, the ribs 810 may experience minimum damage during coiling and reeling by the injector head on the coiled tubing units. Advantageously, these narrow and shallow metal ribs 810 would not cause a significant increase in the expansion force necessary to expand the liner 800.

In another embodiment, a wider rib 810 may provide more contact area and thus more barrier for preventing fluid communication of high pressure fluids between the expanded liner 800 and the parent casing 15. In yet another embodiment, a plurality of ribs 810 may be positioned adjacent each other on the liner 800 to prevent communication between the liner 800 and the parent casing 15. Any suitable number or ribs 810 may be used; such as 2, 3, 6, or 12 or more ribs. The plurality of ribs 810 may ensure at least one of the ribs form a seal in the event the inner surface of the parent casing 15 is not smooth or straight.

Figure 17:
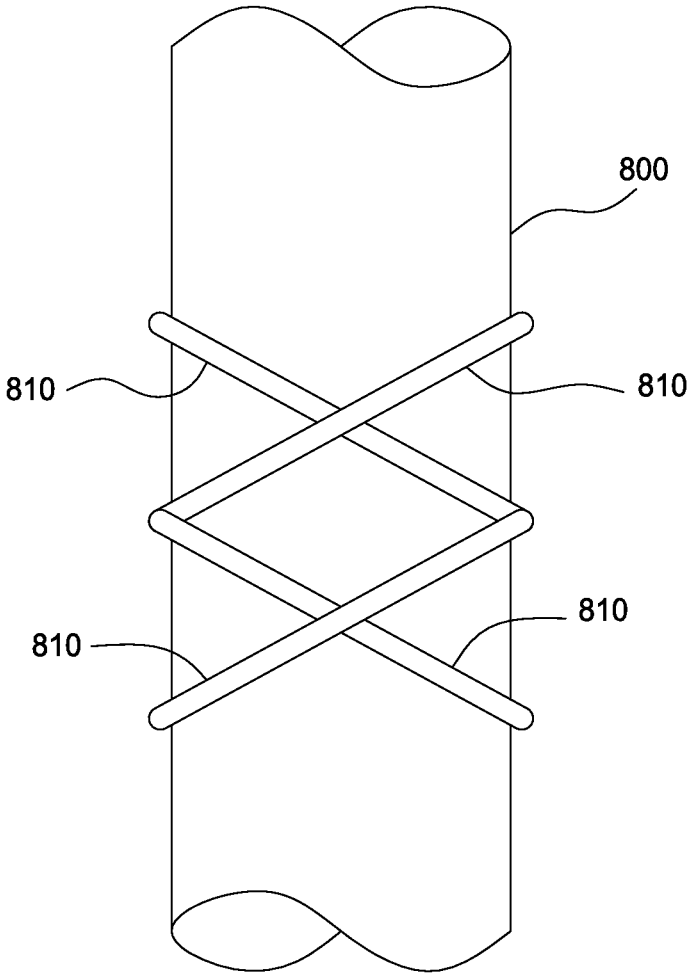
FIG. 17 illustrates an exemplary embodiment of a rib arrangement on a liner.

In one embodiment, the ribs may be arranged in any suitable configuration. For example, the ribs may form a polygonal shape such as a diamond shape. FIG. 17 illustrates one embodiment of this weld bead arrangement. As shown, at least two weld beads 810 are formed at an angle relative to the longitudinal axis of the liner 800. The weld beads 810 may intersect one or more other weld beads 810 at different angles. In another embodiment, one or more weld beads 810 may be parallel to another weld bead.

Figure 18:
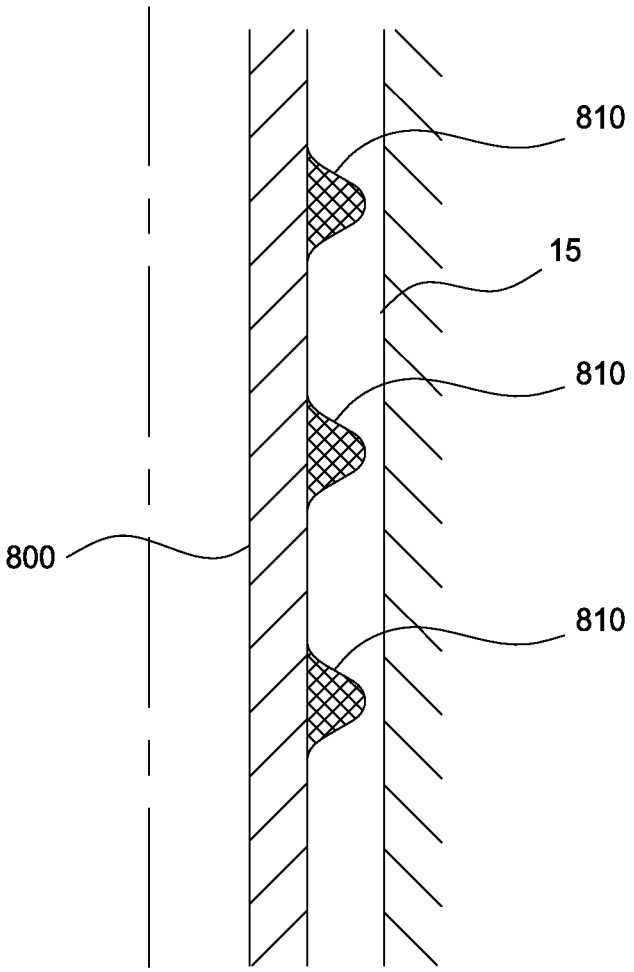
FIG. 18 illustrates another exemplary embodiment of a rib arrangement on a liner.

In another embodiment, the weld beads may be arranged to form a labyrinth seal, as illustrated in FIG. 18. As shown, a plurality of weld beads 810 are axially spaced along the exterior surface of the liner 800. Each weld bead 810 may form a tight seal or may allow a small leak with the parent casing 15. However, the leak only creates a small pressure drop across the weld bead 810; which, taken cumulatively, creates a large overall pressure drop across all of the weld beads 810. Advantages of the labyrinth seal include inhibiting transfer of load or pressure.

In another embodiment, the rib may be made of a material that is softer than the casing or the liner. Exemplary rib materials include brass, aluminum, or combinations thereof. In yet another embodiment, the rib material may be non-metallic so long as the rib material can effectively bond with the liner.

In another embodiment, the rib can be made of material that is harder than either the liner or the parent casing. In this respect, the harder rib may penetrate the surface of the parent casing during expansion. As a result, the harder rib may create a metal to metal seal as well as form a mechanical anchor between the liner and the parent casing. In one embodiment, post-weld shaping of the weld bead may be performed to enhance penetration and sealing contact. It is contemplated that the weld beads may be any suitable shape or arrangement.

In another embodiment, the weld beds may be applied using a welding technique or any suitable mechanism. For example, the weld beads may be applied using a flame spray or a sputtering technique.

Figure 19:
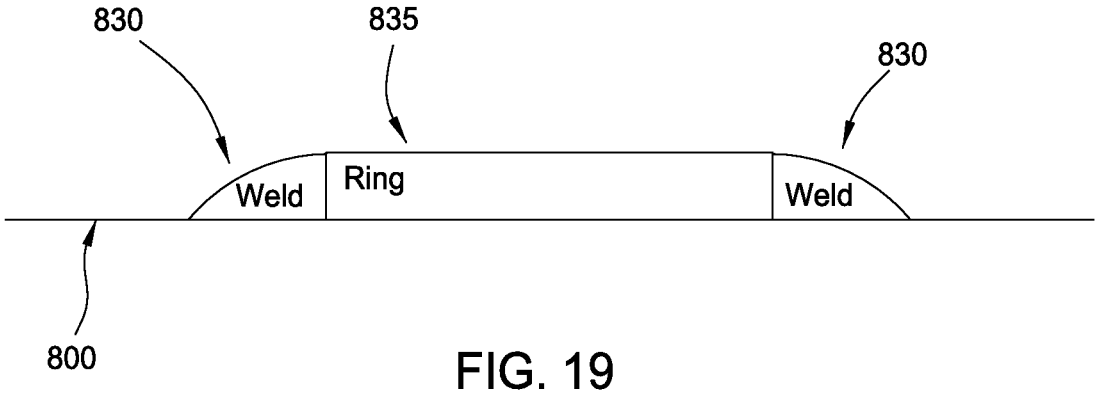
FIG. 19 illustrates an exemplary embodiment of a rib arrangement on a liner, wherein the rib includes a metal ring.

In yet another embodiment, the rib may comprise a ring 835 that is welded to the outer surface of the liner 800, as illustrated in FIG. 19. As shown, welds 830 may be provided at the upper and lower ends of the ring 835 to attach the ring 835 to the liner 800. In one embodiment, the ring 835 may be configured to form a metal to metal seal between the liner 800 and the parent casing 15 during the expansion process. For example, the ring 835 may be made of brass, aluminum, or other metal that is more malleable than the liner 800.

Figure 20:
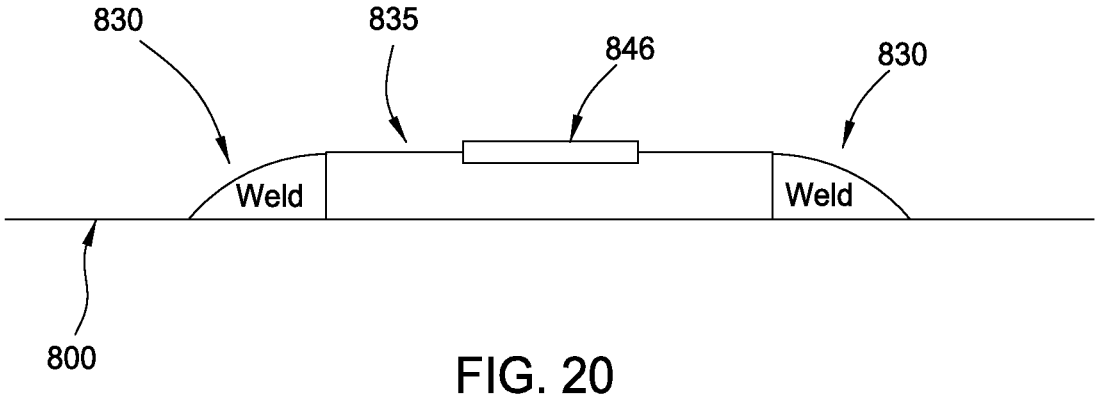
FIG. 20 illustrates an exemplary embodiment of a rib arrangement on a liner, wherein the rib includes a metal ring containing an elastomeric material.

FIG. 20 shows another embodiment of a rib. The rib may include a ring 845 attached to the outer surface of the liner 800 using welds 830. In this embodiment, the outer surface of the ring 845 may include an elastomeric material 846 such as rubber. In one embodiment, the elastomer 846 may be molded into the ring 845, although any suitable method of attaching the elastomer to the ring is contemplated.

Figure 21:
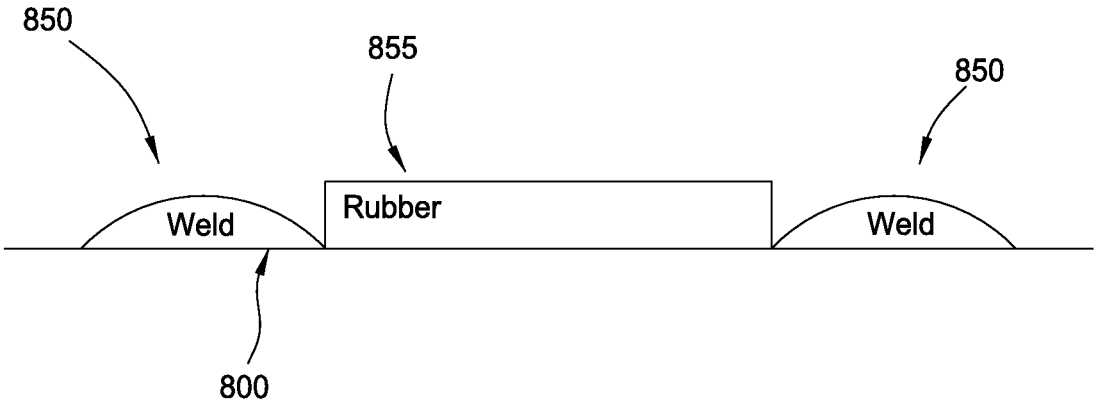
FIG. 21 illustrates an exemplary embodiment of a rib arrangement on a liner, wherein the rib includes an elastomer disposed between two weld beads.

FIG. 21 illustrates another embodiment of a rib used in combination with an elastomer. As shown, weld beads 850 are placed on the liner 800 and on each side of the elastomer 855. The weld beads 850 may protect the elastomer 855 while running into the wellbore. After expansion, the weld beads 850 may help minimize the gap between the elastomer 855 and the parent casing. For example, the weld beads 850 may effectively back up the elastomer 855 and allow the elastomer 855 to hold more pressure and/or load.

Figure 22:
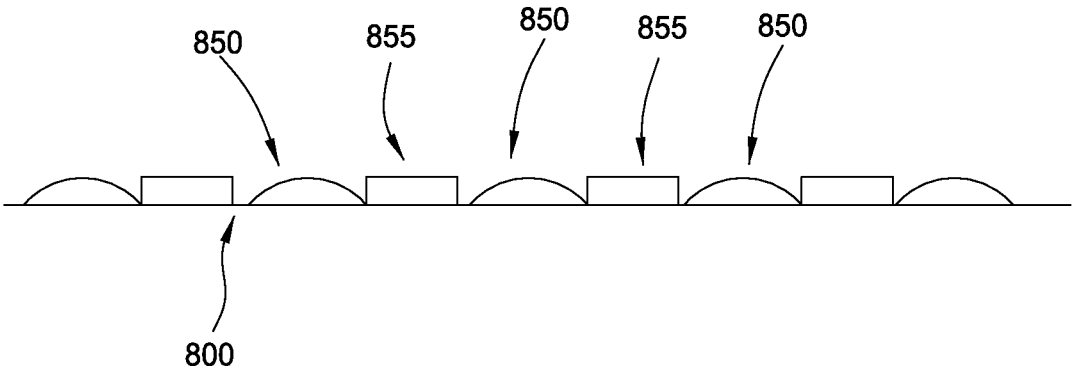
FIG. 22 illustrates an exemplary embodiment of a rib arrangement on a liner, wherein the rib includes multiple elastomers and weld beads.

It is contemplated any suitable number of weld beads 850 and elastomers 855 may be positioned on the liner 800 to provide an effective seal. FIG. 22 illustrates an embodiment showing multiple weld beads and elastomers. As shown, each elastomer 855 is positioned between two weld beads 850. It is further contemplated that one or more of the elastomers may have a different size and/or elastomeric material. It is further contemplated that more than one weld bead 850 may be disposed adjacent to an elastomer 855 or between two elastomers 855.

Figure 23:
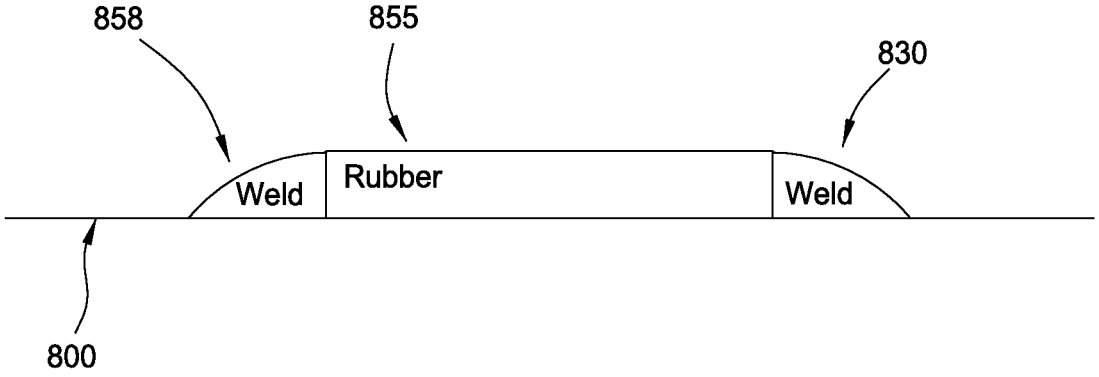
FIG. 23 illustrates an exemplary embodiment of a rib arrangement on a liner, wherein the rib includes an elastomer disposed between two partial weld beads.

FIG. 23 illustrates yet another embodiment of a rib used in combination with an elastomer 855. Similar to FIG. 21, the weld beads 858 are positioned on the liner 800 and on each side of the elastomer 855. In this embodiment, the weld beads 858 are partial welds such as a quarter circle weld, and the elastomer 855 is molded in between the partial weld beads 858. In this respect, the weld beads 858 and the elastomer 855 may act as a unitized system. It is contemplated that the weld beads 858 may be any suitable size for supporting the elastomer 855.

Fourteenth Embodiment

Figure 24:
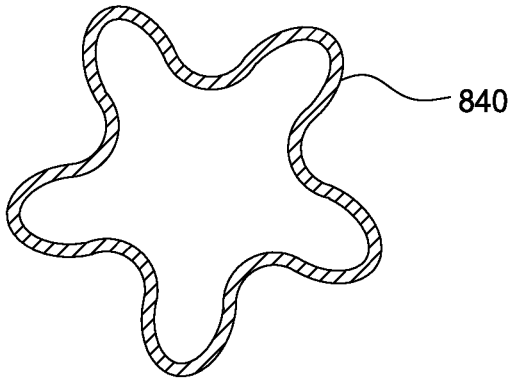
FIG. 24 is a cross-sectional view of an exemplary corrugated expandable liner.

In another embodiment, the expandable liner may have a longitudinally corrugated configuration, which may be reformed into a round configuration downhole. Referring to FIG. 24, in one embodiment, the expandable liner 840 may initially have a star shaped circumference, which is later reformed (and may further be expanded) downhole to a round configuration by an expander tool. It is contemplated that the corrugated liner may have any number of odd or even rounded peaks and valleys. In one embodiment, the corrugated configuration may have a circumference that is substantially equal to the desired final circumference when reformed downhole. In one example, a liner such as a coiled tubing may be formed having the desired circumference. Thereafter, the liner is formed into a longitudinally corrugated shape and lowered into the well, wherein it is reformed back substantially into its original shape and diameter. The wall thickness when reformed into a round shape would not reduce, when compared to expanding a liner past its elastic deformation limit. In another embodiment, the liner length would not change as a result of the reforming process because there would be no substantial radial expansion of the liner. The liner could be deployed along long horizontal wellbore sections with much lower risk of becoming stuck. During operation, the force to drive the expansion system through the corrugated liner is considerably lower than the expansion force requirement for the solid wall liners. In another embodiment, the liner can be formed into the corrugated shape at the coiled tubing mill, a secondary mill or even after going through the coiled tubing injector head by using rolling tools that press the liner into its corrugated shape.

Fifteenth Embodiment

Figure 25:
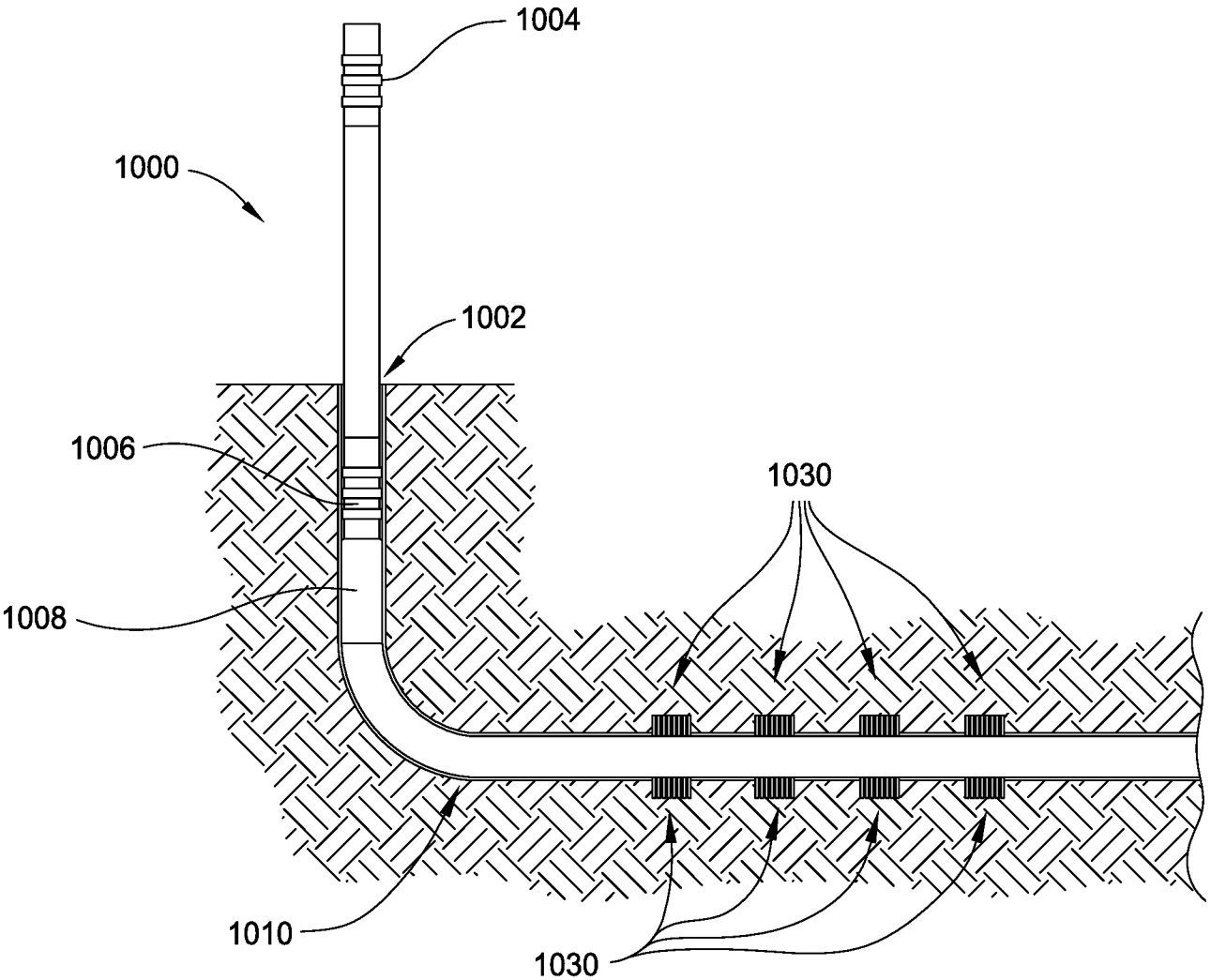
FIGS. 25-32 are sequential views of an embodiment of performing a fracturing operation using an exemplary expandable liner.

FIGS. 25 to 32 illustrate another embodiment of an expandable liner and the sequential operation of running and expanding the liner downhole. Referring to FIG. 25, the expandable liner 1000 is deployed into the wellbore 1002, which is shown having a horizontal wellbore. FIG. 25 is shown as the first step in the operation sequence. The liner is a coiled tubing that will be expanded downhole. The upper end of the liner 1000 is held by a rig (not shown) and the lower end of the liner is inserted into the wellbore. A top anchor 1004 is installed on top of the liner and may include carbide disposed on its exterior. An exemplary top anchor is the anchor discussed above in FIG. 14. The top anchor may be attached to the liner at the well site. A bottom anchor 1006 may be attached to the lower end of the liner. The bottom anchor may be substantially similar to the top anchor. A casing anchor 1008 may be attached below the liner and the bottom anchor. An exemplary casing anchor is the anchor discussed above in FIG. 15.

Figure 26A:
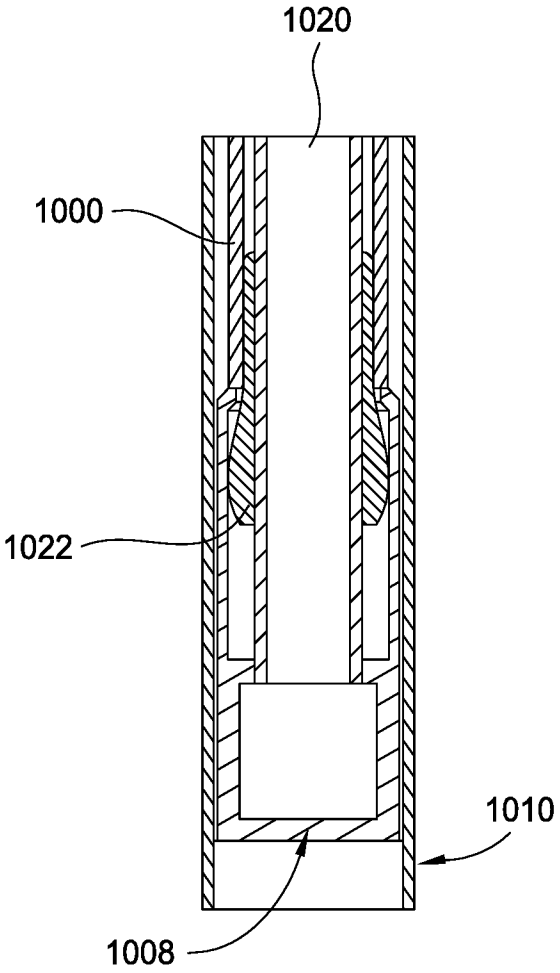
FIG. 26*a* illustrates an exemplary embodiment of an inner string deployed into the expandable liner and attached to the cone assembly in the casing anchor.
Figure 26:
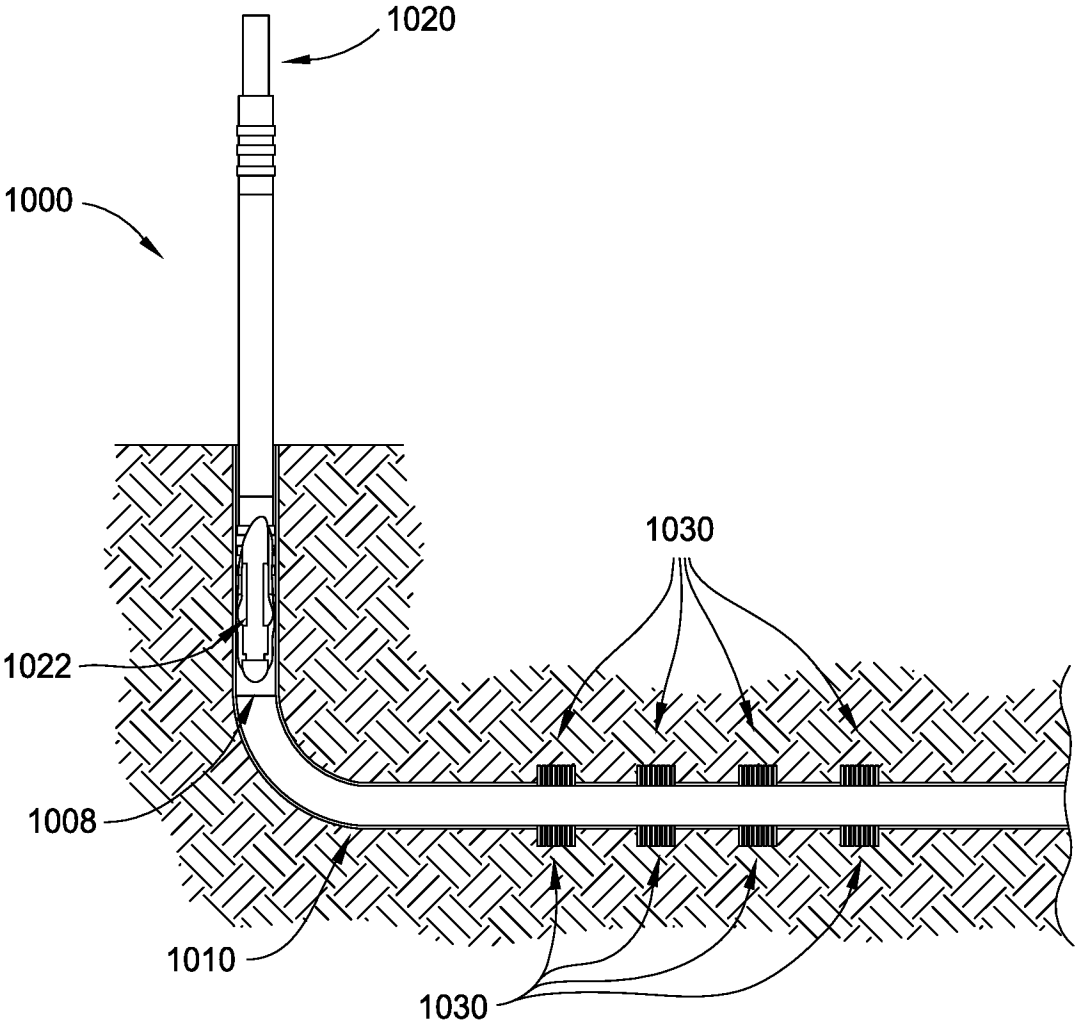

At step 2, an inner string 1020 such as an inner coiled tubing is deployed into the liner 1000, as shown in FIG. 26 and FIG. 26*a*. The inner string is run to the bottom of the liner, where it is connected to the cone assembly 1022 in the casing anchor 1008.

Figure 27:
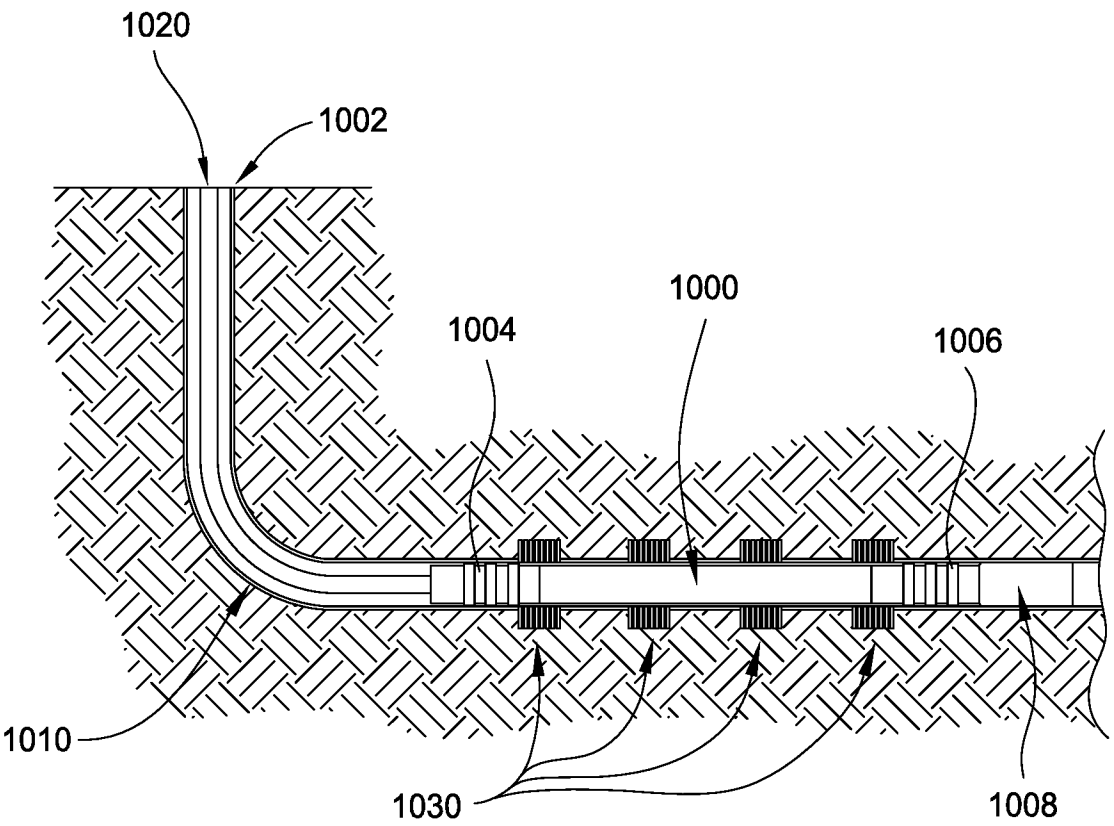

At step 3, the liner 1000 is released from the rig and run into position using the inner string 1020, as shown in FIG. 27. It can be seen the liner 1000 has been deployed into the horizontal wellbore 1002 adjacent the perforations 1030 of the previously installed casing 1010.

Figure 28:
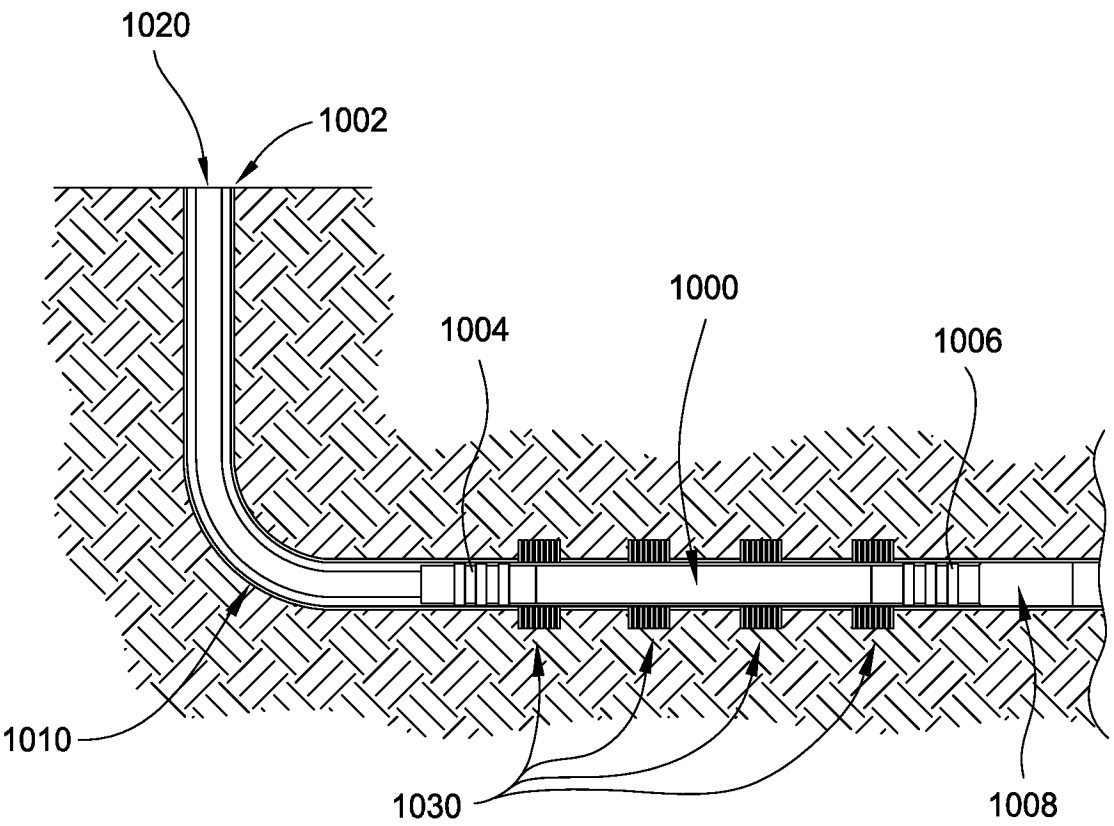

At step 4, the casing anchor 1008 is set by supplying hydraulic fluid through the inner string 1020 to the casing anchor. FIG. 28 shows the casing anchor after expansion.

Figure 29:
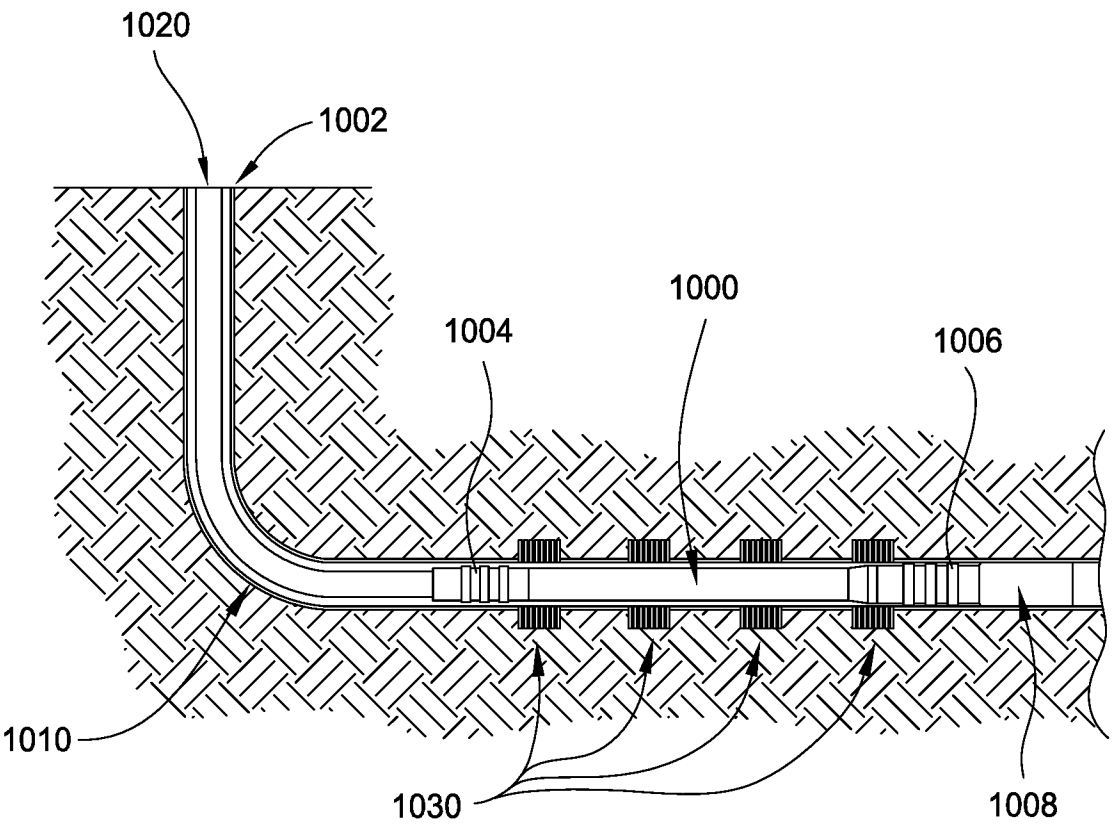

At step 5, the inner string 1020 is pulled up to pull the cone 1022 through the liner's bottom anchor. FIG. 29 shows the bottom anchor 1006 just after it has been set by expansion.

Figure 30:
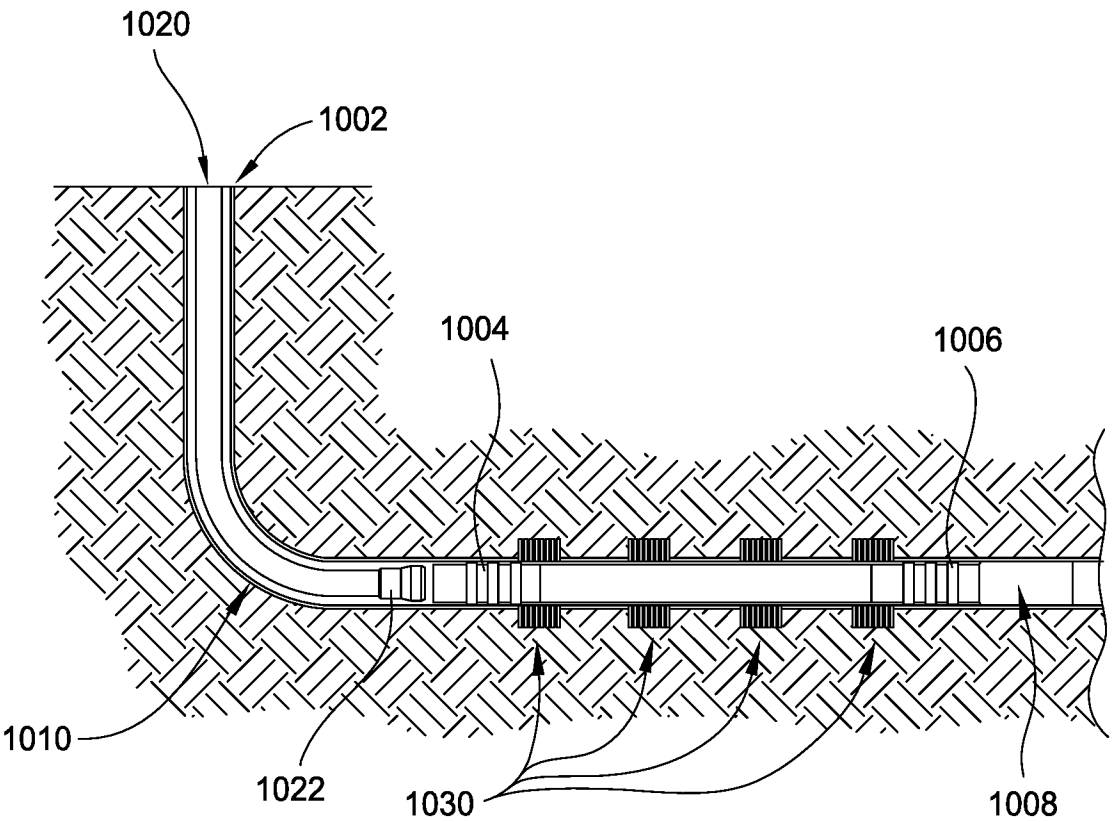

At step 6, the inner string 1020 continues to be pulled until the liner 1000 is fully expanded, including the top anchor 1004. FIG. 30 shows the liner after expansion and the cone 1022 exiting the liner.

Figure 31:
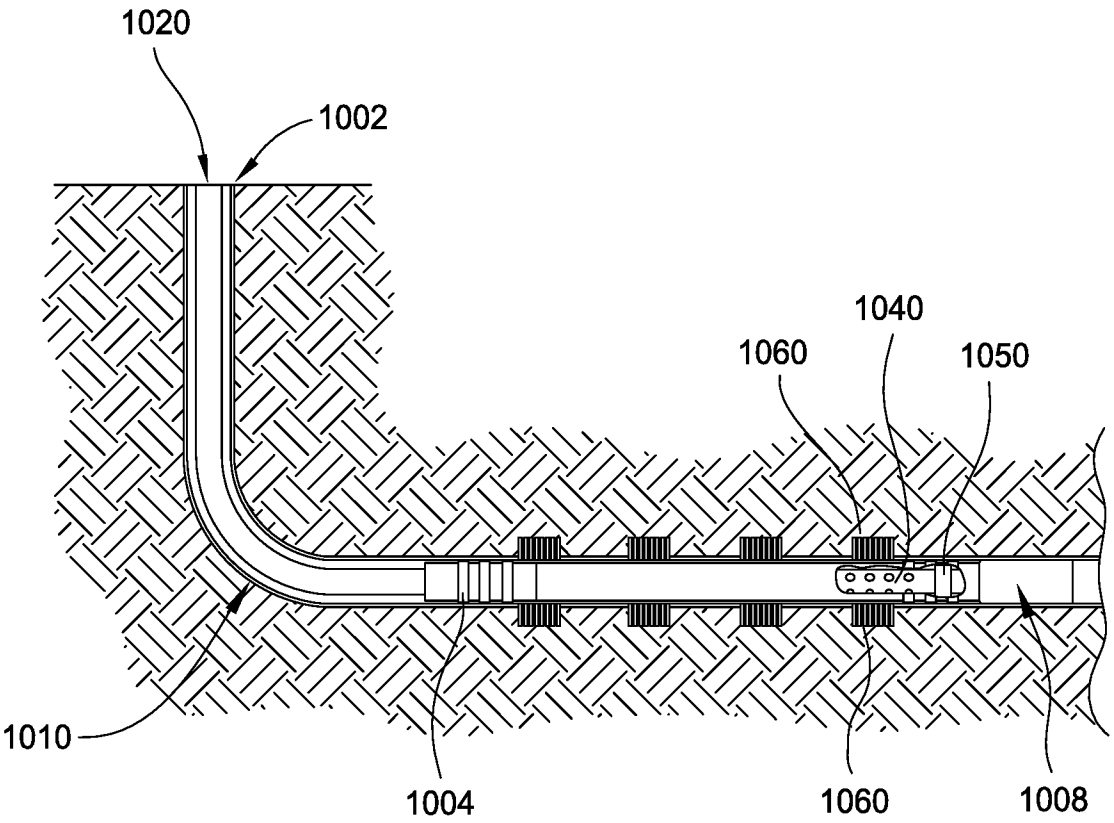

At step 7, the perforating gun 1040 and the frac plug 1050 are deployed into the liner. FIG. 31 shows the perforating gun and frac plug in position. New perforations 1060 are formed for stage 1 of the fracturing operation, and the frac plug is set. Thereafter, the perforating gun and inner string 1020 are retrieved from the wellbore 1002.

Figure 32:
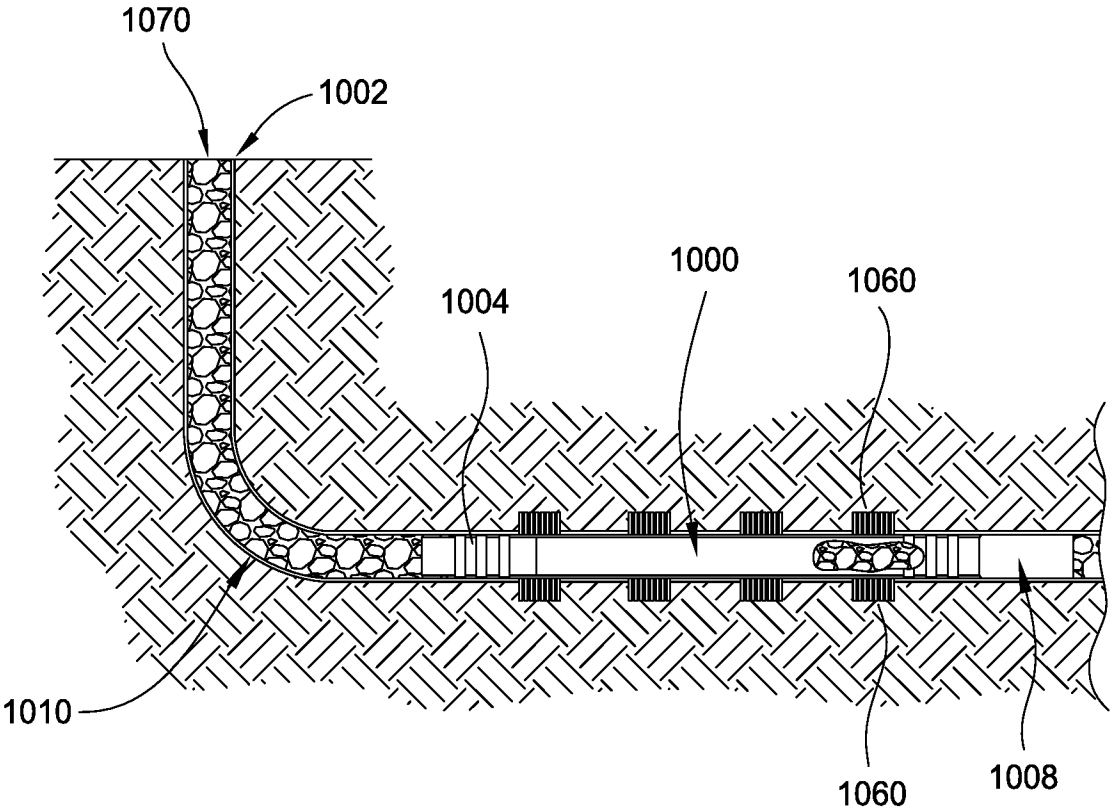

At step 8, fracturing 1070 is supplied through the liner 1000 and the casing to perform stage 1 of the fracturing operation. FIG. 32 shows the fracturing fluid being supplied downhole. Steps 7 and 8 repeated to perform the remaining fracturing stages.

It is contemplated features of each embodiment may optionally be used with another embodiment. For example, the shearable connection discussed with respect to the fifth embodiment may be included with the expandable liner of the sixth embodiment.

In another embodiment, a method of completing a wellbore includes providing a coiled tubing having an anchor at a first end; setting the anchor; expanding the coiled tubing; perforating the coiled tubing; and supplying a fluid through the coiled tubing.

In one or more of the embodiments described herein, the method includes conveying the coiled tubing using a second, smaller diameter coiled tubing.

In one or more of the embodiments described herein, the method includes using a packer type system to preventing axial movement of coiled tubing during setting of the anchor.

In one or more of the embodiments described herein, the coiled tubing is expanded by pulling an expander tool using a coiled tubing unit at the surface.

In one or more of the embodiments described herein, the coiled tubing includes an elastomeric outer coating.

In another embodiment, an expandable liner includes an expandable tubular body; and an expandable threaded portion welded to each end of the tubular body, wherein the threaded portion has a higher strength than the tubular body.

In one or more of the embodiments described herein, the expandable threaded end is strengthened using a localized quenching and tempering process.

In one or more of the embodiments described herein, the threaded portion comprises P-110 strength.

In another embodiment, an expandable liner includes an expandable tubular having a threaded connection, wherein the threaded connection includes a groove configured to fail at a predetermined tension load.

In one or more of the embodiments described herein, the groove is disposed on a box portion of the threaded connection.

In one or more of the embodiments described herein, the groove is disposed between the box portion and a pin portion of the threaded connection.

In one or more of the embodiments described herein, the groove is disposed outside of the threads of the threaded connection.

In one or more of the embodiments described herein, the liner includes a sealing element configured to maintain seal integrity of the threaded connection when the groove fails.

In one or more of the embodiments described herein, the sealing element is disposed between a pin portion and a box portion of the connection.

In one or more of the embodiments described herein, the liner includes two sealing members disposed on the exterior of the expandable tubular and on each side of the threaded connection.

In another embodiment, a method of completing a wellbore includes providing an expandable liner having a first anchor and a second anchor at a lower end; setting the second anchor to temporarily hold the liner against a casing; and expanding the liner and setting the first anchor using an expander cone.

In one or more of the embodiments described herein, the second anchor comprises a slotted tubular.

In one or more of the embodiments described herein, the second anchor comprises a thinner wall section than the liner.

In one or more of the embodiments described herein, the method setting a third anchor, wherein the second anchor is disposed between the first and second anchor.

In one or more of the embodiments described herein, the second anchor is set by hydraulic pressure.

In one or more of the embodiments described herein, the second anchor is attached to the liner using a sleeve.

In one or more of the embodiments described herein, the expander cone is initially housed in the sleeve.

In one or more of the embodiments described herein, the liner has a corrugated shape.

In one or more of the embodiments described herein, the method includes lowering the liner using a coiled tubing.

In one or more of the embodiments described herein, the second anchor is set by hydraulic pressure.

In one or more of the embodiments described herein, the method includes forming a perforation in the liner and supplying a fracturing fluid through the perforation.

In another embodiment, an expandable liner for use with an outer tubular includes an expandable tubular having a rib disposed around an outer diameter of the expandable tubular, wherein the rib is configured to form a seal with the outer tubular.

In one or more of the embodiments described herein, the rib comprises a weld bead.

In one or more of the embodiments described herein, the rib comprises a material that is softer than the expandable tubular.

In one or more of the embodiments described herein, a plurality of ribs are disposed on the expandable tubular.

In one or more of the embodiments described herein, the liner includes an elastomeric material.

In one or more of the embodiments described herein, the elastomeric material is disposed between two ribs.

In one or more of the embodiments described herein, the plurality of ribs form a labyrinth seal.

In one or more of the embodiments described herein, the at least one rib is positioned at an angle relative to a longitudinal axis of the expandable tubular.

In one or more of the embodiments described herein, the rib comprises a metal ring disposed around the expandable tubular, wherein one or more weld beads are used to attach the metal ring to the expandable tubular.

In one or more of the embodiments described herein, the liner includes an elastomeric material coupled to the metal ring.

In one or more of the embodiments described herein, the rib is raised about 0.1 inches to about 0.25 inches above an outer surface of the expandable tubular.

In one or more of the embodiments described herein, the rib comprises a material that is harder than the expandable tubular.

In one or more of the embodiments described herein, the rib comprises a non-metallic bead.

In one or more of the embodiments described herein, the rib is applied onto the expandable tubular using a mechanism selected the group consisting of a welding technique, a flame spray, a sputtering application, and combinations thereof.

In one or more of the embodiments described herein, the metal rib extends about 0.7 inches to about 1.3 inches along an axial length of the expandable tubular and is raised about 0.1 inches to about 0.25 inches above an outer surface of the expandable tubular.

In another embodiment, a method for use in a wellbore includes deploying an expandable tubular into the wellbore, the expandable tubular having a rib extending circumferentially around its outer surface; radially expanding the expandable tubular substantially against an inner wall of the wellbore; and substantially preventing fluid flow along an axial length of an interface between the radially expanded tubular and the inner wall of the wellbore, using the rib.

In one or more of the embodiments described herein, the rib comprises a weld bead.

In one or more of the embodiments described herein, the rib comprises a material that is softer than the expandable tubular.

In one or more of the embodiments described herein, a plurality of ribs are disposed on the expandable tubular.

In one or more of the embodiments described herein, the method includes disposing an elastomeric material adjacent one of the ribs.

In one or more of the embodiments described herein, the elastomeric material is disposed between two ribs.

In one or more of the embodiments described herein, the plurality of ribs form a labyrinth seal.

In one or more of the embodiments described herein, the method includes positioning at least one rib at an angle relative to a longitudinal axis of the expandable tubular.

In one or more of the embodiments described herein, the rib comprises a metal ring disposed around the expandable tubular, and attaching the to attach the metal ring to the expandable tubular using one or more weld beads.

In one or more of the embodiments described herein, the method includes coupling an elastomeric material to the metal ring.

In one or more of the embodiments described herein, the rib comprises a non-metallic bead.

In one or more of the embodiments described herein, the method includes disposing the rib onto the expandable tubular using a mechanism selected the group consisting of a welding technique, a flame spray, a sputtering application, and combinations thereof.

In another embodiment, an expandable liner includes an expandable tubular having a metal rib disposed around an outer diameter of the tubular, wherein the metal rib extends about 0.7 inches to about 1.3 inches along an axial length of the expandable tubular and raised about 0.1 inches to about 0.25 inches above an outer surface of the expandable tubular.

While the foregoing is directed to embodiments of the present invention, other and further embodiments of the invention may be devised without departing from the basic scope thereof, and the scope thereof is determined by the claims that follow.

The invention claimed is:

1. A method of completing a wellbore, comprising:

providing an expandable liner having an anchor at a first end and a free end at a second end, wherein the free end includes at least a substantial portion of the expandable liner;

setting the anchor;

expanding the liner while allowing the free end to shrink or grow during expansion, wherein, after expansion, an annular gap is present between the free end of the liner and the wellbore; and after expanding the liner, supplying a fluid into the liner and through perforations in the liner while allowing the free end to shrink or grow in response to the changes in length of the liner while supplying the fluid.

2. The method of claim 1, wherein the fluid is a high pressure fracturing fluid.

3. The method of claim 2, further comprising perforating the liner to form openings in the liner after expanding the liner.

4. The method of claim 3, wherein perforating the liner comprises forming a slot in the liner.

5. The method of claim 1, wherein the liner comprises a coiled tubing.

6. The method of claim 5, further comprising conveying the coiled tubing using a second, smaller diameter coiled tubing.

7. The method of claim 5, wherein expanding the coiled tubing comprises pulling an expander tool using a coiled tubing unit at the surface.

8. The method of claim 5, further comprising using a packer type system for preventing axial movement of coiled tubing during setting of the anchor.

9. The method of claim 5, wherein the coiled tubing includes an elastomeric outer coating.

10. The method of claim 1, further comprising forming openings in the liner while allowing the free end to shrink or grow.

11. The method of claim 1, wherein the fluid is supplied to perform a fracturing operation.

12. The method of claim 1, wherein a radial distance between an outer diameter of the expanded liner and the wellbore is between about 10% and about 5% of the outer diameter of the expanded liner.

13. The method of claim 1, wherein a radial distance between the expanded liner and the wellbore is between about 0.25 inches and about 0.15 inches.

14. A method of completing a wellbore, comprising:

providing an expandable liner having a lower end, the lower end equipped with an expander cone, a first anchor and a second anchor;

setting the second anchor to hold the liner against a casing while the expander cone remains unactivated;

activating the expander cone to expand the liner and setting the first anchor, wherein, after expansion, an annular gap is present between an upper end of the liner and the wellbore; and after expanding the liner, supplying a fluid into the liner and through perforations in the liner while allowing at least a substantial portion of the expandable liner to shrink or grow in response to the changes in length of the liner while supplying the fluid.

15. The method of claim 14, wherein the second anchor comprises a slotted tubular.

16. The method of claim 14, wherein the second anchor comprises a thinner wall section than the liner.

17. The method of claim 14, wherein the liner has a corrugated shape.

18. The method of claim 14, wherein the second anchor is attached to the liner using a sleeve.

19. The method of claim 14, wherein the expander cone is initially housed in the sleeve.

20. The method of claim 14, further comprising forming the perforations in the liner after setting the first anchor.

21. The method of claim 14, wherein the second anchor is set using an inflatable packer.

* * * * *